US006659591B2

(12) United States Patent
Sato et al.

(10) Patent No.: US 6,659,591 B2
(45) Date of Patent: Dec. 9, 2003

(54) INK JET RECORDING HEAD AND PRODUCING METHOD FOR THE SAME

(75) Inventors: Osamu Sato, Kanagawa (JP); Mineo Kaneko, Tokyo (JP); Yasutomo Watanabe, Kanagawa (JP); Kyota Miyazaki, Tokyo (JP); Shuzo Iwanaga, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/899,258

(22) Filed: Jul. 6, 2001

(65) Prior Publication Data

US 2002/0089567 A1 Jul. 11, 2002

(30) Foreign Application Priority Data

Jul. 10, 2000 (JP) ..... 2000-209030
Jul. 10, 2000 (JP) ..... 2000-209090

(51) Int. Cl.[7] ..... B41J 2/14
(52) U.S. Cl. ..... 347/50; 347/58
(58) Field of Search ..... 347/20, 40, 50, 347/56, 58, 63

(56) References Cited

U.S. PATENT DOCUMENTS

| | | | | |
|---|---|---|---|---|
| 5,608,435 A | | 3/1997 | Koizumi et al. | 347/58 |
| 5,751,316 A | * | 5/1998 | Bailey et al. | 347/63 |
| 6,076,912 A | | 6/2000 | Murthy | 347/18 |
| 6,186,613 B1 | | 2/2001 | Watanabe et al. | 347/17 |
| 6,241,340 B1 | | 6/2001 | Watanabe et al. | 347/50 |
| 6,257,703 B1 | | 7/2001 | Hirosawa et al. | 347/50 |

FOREIGN PATENT DOCUMENTS

| | | | | |
|---|---|---|---|---|
| EP | 0 677 387 A | | 10/1995 | |
| EP | 0 709 202 A | | 5/1996 | |
| EP | 0 822 078 A | | 2/1998 | |
| EP | 0 822 082 A | | 2/1998 | |
| JP | 9-300624 | | 11/1997 | |
| JP | 10-776 | | 1/1998 | |
| JP | 10000776 A | * | 1/1998 | B41J/2/05 |
| JP | 2839686 | | 12/1998 | |
| JP | 11-138814 | | 5/1999 | |

* cited by examiner

*Primary Examiner*—Anh T. N. Vo
(74) *Attorney, Agent, or Firm*—Fitzpatrick, Cella, Harper & Scinto

(57) ABSTRACT

A method for producing an ink jet recording head having a plurality of recording element substrates each including a recording element for generating energy to be used for ink discharge and an electrode portion connected to the recording element, a wiring substrate provided with an electrode terminal to be electrically connected with the electrode portion of the plural recording element substrates and adapted to transmit an electrical pulse for ink discharge to the recording element, and an element substrate support member for supporting the plural recording element substrates, comprises a step of causing the plural recording element substrates to be supported on the element substrate support member, and a step of thereafter executing metal—metal bonding between the electrode portion of the plural recording element substrates and the electrode terminal of the wiring substrate.

26 Claims, 29 Drawing Sheets

PRIOR ART

PRIOR ART

INK JET RECORDING HEAD AND PRODUCING METHOD FOR THE SAME

BACKGROUND OF THE INVENTION

1. Field of the Invention

The present invention relates to an ink jet recording head adapted for use in an ink jet recording apparatus for executing recording operation by discharging liquid such as ink, and a producing method therefor. The present invention is applicable not only to an ordinary printing apparatus but also to an apparatus such as a copying apparatus, a facsimile apparatus provided with a communication system or a work processor provided with a printing unit, or to a multi-function recording apparatus formed by complexing these apparatuses.

2. Related Background Art

The ink jet recording apparatus is a recording apparatus of so-called non-impact recording method, and has various features such as high speed recording, ability of recording on various recording media and scarce noise generation at the recording. For these reasons, the ink jet recording apparatus is widely employed in the recording mechanism of the printer, copying apparatus, facsimile, word processor etc.

As the representative ink discharging method in a recording head mounted on such ink jet recording apparatus, there is known a method of employing an electromechanical converting member such as a piezo element, a method of generating heat by irradiation of an electromagnetic wave for example with a laser and discharging an ink droplet by the action of such heat generation, and a method of heating ink by an electrothermal converting element having a heat generating resistance member and discharging an ink droplet by the action of film boiling. In an ink jet recording head employing the electrothermal converting element, such element is provided in a recording liquid chamber and is given an electric pulse constituting a recording signal to provide the ink with thermal energy, and the pressure of a bubble generated in the recording liquid (at the boiling thereof) resulting from a phase change therein to discharge a small ink droplet from a small discharge opening, thereby executing recording on a recording medium. In general, such ink jet recording head is provided with an ink jet recording nozzle and a supply system for supplying the nozzle with the ink.

For forming such recording head, there is already known, as disclosed in the Japanese Patent Application Laid-open No. 10-776, there is known a method of adhering and patterning a copper foil of a thickness of 50 microns on a polyimide film, electrically jointing, by thermal ultrasonic pressing, bumps on electrode pads on a recording element to the gold-plated electrode leads (inner leads) of thus formed TAB (tape automated bonding) tape, then sealing the jointed portion and adhering the assembly to a substrate. Also the Japanese Patent Application Laid-open No. 9-300624 proposes a method of processing the electrode after bump formation. Also the Japanese Patent Application Laid-open No. 11-138814 discloses a method of connecting plural recording elements to respectively independent TAB tapes and then adhering them to a substrate. In the configuration shown in the aforementioned Japanese Patent Application Laid-open No. 11-138814, there are provided plural recording elements for color printing, but there is also known a recording head which is internally divided so as to enable color printing by a single substrate.

The price of the ink jet recording apparatus is recently showing a remarkable reduction, so that the major issue is how to produce the ink jet recording head inexpensively. For this purpose, most effective is the reduction of the material cost of the component parts, particularly the integration of the substrate for the recording element, and there is widely employed a method of integrating the substrates of the recording elements for the inks of yellow, megenta and cyan colors. There are also employed a method of integrating the substrate of the recording element for the black ink frequently used for character printing with the aforementioned substrate of the color recording elements and a method of incorporating the substrate of the color recording elements and the substrate of the black recording element into a same recording head. For example the Japanese Patent No. 2839686 discloses a method of mounting plural different recording element substrates on a single TAB tape as an example of the driving semiconductor device. Such mounting method is to constitute a circuit by mutually connecting plural recording element substrates. However, in the configuration of connecting the plural recording elements respectively to the independent TAB tapes and then adhering to the support member as disclosed in the Japanese Patent Application Laid-open No. 11-138814, it is necessary to align each TAB tape with the support member at the adhering operation, while the recording apparatus inevitably becomes bulky since the recording elements cannot be positioned mutually very close, and the capping mechanism, for preventing liquid evaporation in the non-recording state, has to be made independent for each recording element. Furthermore, since a component, in which the TAB tape and the recording element are combined, has to be adhered to the support member, it is difficult to fix the recording element to the support member with sufficient precision. In case plural recording elements are present, it is even more difficult to adhere such recording elements with sufficient relative precision. Also since an operation of sealing the electrode leads (inner leads) with resin has to be executed in the air, the sealing agent ordinarily employed in the TAB technology may flow to and clog the discharge opening for discharging the recording liquid, or the inner leads may be exposed if the amount of the sealing agent is reduced in order to prevent such clogging phenomenon. Furthermore, the resin for sealing the inner leads may flow to the back side of the recording element so that some of the recording elements may become unable to be fixed.

Also in case of assembling the black ink recording element substrate and the color ink recording element substrate within a same head, it is necessary to mutually align the relative position of the respective liquid discharge openings. However, if an inner lead bonding step, for jointing the electrodes of a semiconductor chip with the inner leads (electrode leads) protruding in a device hole (aperture) provided in the film carrier tape, and a step of sealing the inner leads with resin, both steps being common in the TAB technology, are executed prior to the assembly of each recording element substrate into the head, the precision of the relative positional relationship of the discharge openings may be deteriorated to result in significant mutual blotting of the black ink and the color inks or in mutual positional displacement thereof at the ink jet recording operation.

Now there will be given an explanation on the conventional recording element unit with reference to FIGS. 24 and 25, which show, in the conventional TAB mounting process, a method of electrically jointing bumps on the electrodes of the recording element to the electrode leads of an electric wiring tape by thermal ultrasonic pressing, then sealing the jointed portion and adhering it to a support member.

In the conventional configuration shown in FIGS. 24 and 25, an electrical wiring tape H300 has a three-layered structure in the vicinity of the bonding portion, consisting of a polyimide base film H300*a* at the top side, a copper foil H300*b* in the middle and a solder resist H300*c* at the rear side. The electrical wiring tape H300 is provided with a device hole (aperture) H11 in which a recording element substrate H100 is inserted and a device hole H12 in which a recording element substrate H101 is inserted, and, in such holes, there are exposed gold-plated electrode leads (inner leads) H302 to be connected to bumps H5 of the recording element substrate H100 or H101.

In the first recording element substrate H100 and the device hole H11 of the electrical wiring tape H300, the conventional TAB mounting method is used to align the electrode leads H302 of the electrical wiring tape (TAB tape) H300 with the bumps H5 on the electrodes of the recording element H100, then to execute electrical jointing by thermal ultrasonic pressing method and to seal the jointed portion with a sealing agent H308 thereby obtaining a TAB unit H300U1. Also, in the second recording element substrate H101 and the device hole H12 of the electrical wiring tape H300, the electrode leads H302 of the electrical wiring tape (TAB tape) H300 are electrically jointed with the bumps H5 on the electrodes of the recording element H100 by thermal ultrasonic pressing method and the jointed portion is sealed with the sealing agent H308 to obtain a TAB unit H300U2. The TAB units are separated because, in the conventional TAB mounting method, it is difficult to obtain the positional precision of the chip (recording element substrate) with respect to the TAB tape after sealing, sufficient for use in the ink jet recording apparatus (particularly color recording apparatus).

Then a second plate H400 is adhered to the first plate H200 by a second adhesion layer H203, of which thickness is limited to 0.06 mm or less in order that the first recording element substrate H100, the second recording element substrate H101 and the electrical wiring tape H300 can be electrically connected in planar manner.

Then a first adhesion layer H202 for adhering the first recording element substrate H100 and the second recording element substrate H101 and a third adhesion layer H306 for adhering the electrical wiring tape H300 are formed by coating respectively on the first plate H200 and on the second plate H400, and the TAB units H300U1 and H300U2 are fixed by pressing with relative positional alignment of the plural recording elements H103 for discharging recording liquids or respective discharge openings H107 along the plane of wiring. In this operation, since the sealing agent H308 is deposited on the upper face (ink discharging surface) of the first and second recording element substrates H100, H101, pressing heads H100H, H101H having suction pipes V110 are limited in the contact areas with the recording element substrates H100, H101 in order to avoid such deposited areas. Also the sealing agent H308 usually stops at the ridge of the recording element substrate and seldom flows to the adhesion surface, but it may occasionally flow to such adhesion surface because of a fluctuation in the viscosity of the sealing agent, and, in such case, the first or second recording element substrate H1100, H101 may become inclined by the thickness of thus deposited sealing agent, thus resulting in an inclined liquid discharge direction or ink leakage.

Subsequently, in order to securely adhere the electrical wiring tape H300 to the second plate H400, the electrical wiring tape H300 is pressed and fixed to the second plate H101 by a tape pressing head T300. In the operation of pressing the first and second recording element substrates H100, H101 for adhesion fixing, the electrical wiring tape H300 and the third adhesion layer H306 are preferably not in mutual contact, because, if the pressing is insufficient, the first and second recording element substrates H100, H101 remain in a floating state to result in an inclined liquid discharge direction or ink leakage.

Furthermore, the ink jet recording head of the above-described configuration including plural recording element substrates which are electrically connected with the electrical wiring tape is associated with the following drawbacks:

(1) When the arrangement pitch of the electrodes becomes smaller for example by a higher density or a higher level of integration of the recording element substrate, there tends to be generated an electrical shortcircuiting in thermal ultrasonic jointing of the electrode terminals of the electrical wiring tape to the bumps on the electrodes of the recording element substrate;

(2) When the number of the recording elements per recording element substrate increases, there increases the number of necessary electrodes, resulting in an increase in the probability of the electrical shortcircuiting mentioned in (1) per recording element substrate;

(3) If the arrangement pitch of the electrodes of the recording element substrate is increased in order to avoid the drawbacks (1) and (2), the size of the recording element substrate itself may be increased to elevate the cost thereof. Also the recording head may become larger to increase the dimension of the recording apparatus, thus eventually increasing the cost thereof; and (4) In case of aligning the recording element substrate with the support member or aligning the electrode terminals of the electrical wiring tape with the bumps on the electrodes of the recording element substrate, there inevitably result a positional aberration resulting from the fluctuation in the assembling in the aligning operation, and such aberration, if becoming large, may result in electrical shortcircuiting at the thermal ultrasonic pressing of the electrodes and the electrode terminals. The probability of such electrical shortcircuiting varies depending on the aligning position between the electrode terminals of the electrical wiring tape and the electrodes of the recording element substrate.

SUMMARY OF THE INVENTION

In consideration of the foregoing, an object of the present invention is, in an ink jet recording head in which plural recording element substrates are adhered to a same support member, to improve the reliability of inner lead bonding and to realize secure electrical connection, by at first adhering semiconductor chips (recording element substrates) to the support member, and then executing an inner lead bonding step (step for jointing the inner leads (electrode leads) protruding in the device hole provided in the film carrier tape and the electrodes of the semiconductor chip) and a step of sealing the inner leads with resin, as already known in the conventional TAB technology.

Another object of the present invention is to provide an inexpensive ink jet recording head capable of high-quality ink jet recording.

By employing metal—metal bonding such as thermal ultrasonic pressing on the bump and the electrode lead, the reliability of connection can be secured even when the bump and the electrode lead are jointed after the recording element substrate and the flexible wiring substrate are fixed to a first support member. Also there can be provided an inexpensive ink jet recording head, since standardized apparatus and technology can be used.

Also by adhering a second support member to the first support member in such a manner that the distance between the upper surface of the second support member and the upper surface of the bumps on the plural recording element substrates becomes constant, there can be provided an inexpensive ink jet recording head of satisfactory reliability. In such operation, by correcting and smoothing the fluctuation in the height of the upper surfaces of the bumps on the plural recording element substrates, there can be provided an ink jet recording head of even higher reliability.

Also by executing the resin sealing of the pointed portions of the bumps on the recording element substrate and the electrode leads of a single flexible wiring substrate after such single flexible wiring substrate is fixed to the second support member, there can be achieved stable resin sealing, thereby providing a more inexpensive ink jet recording head.

Also there can be provided an inexpensive ink jet recording head of high print quality and high realiability, by fixing, with an adhesive material, the plural recording element substrates to the first support member to which the second support member is adhered with an adhesive material, then aligning the electrodes of the recording element substrates with the electrode leads of the wiring substrate, then fixing the wiring substrate to the second support member with an adhesive material, jointing the electrodes of the recording element substrate with the electrode leads of the single flexible wiring substrate and sealing, with resin, the jointed portions of the electrodes of the recording element substrates and the electrode leads of the single flexible wiring substrate.

By executing metal—metal bonding between the bump and the electrode lead, there can be provided an ink cartridge of higher productivity.

Also there can be provided an inexpensive ink jet recording head of high print quality and high reliability, by maintaining a constant distance between the upper surface of the second support member and the upper surface of the bumps and then sealing the metal—metal bonded portions and jointed portions.

Still another object of the present invention is to providing a producing method for an inexpensive ink jet recording head capable of ink jet recording of high quality, in which the defect rate is reduced in the electrical connection between the electrodes of the recording element substrate and the electrode terminals of the electrical wiring tape electrically connected to the recording element substrate, and an ink jet recording head produced by such method.

In connecting the electrode terminals of an external wiring substrate, since the alignment is made between the electrodes of the first recording element substrate, arranged with a smaller first arrangement pitch, and the electrode terminals of the external wiring substrate corresponding to such smaller first arrangement pitch, the electrode terminals of the first recording element substrate with a higher electrical shortcircuiting rate are aligned with better precision and the electrical shortcircuiting rate is reduced in the entire head. Therefore, in electrically connecting the electrodes and the electrode terminals for example by metal—metal bonding, there can be reduced the electrical defects resulting for example from the electrical shortcircuiting, induced for example by the electrode terminal being also connected to an electrode adjacent to the electrode to which the electrode terminal is to be connected.

A reduction in the arrangement pitch of the electrodes of the recording element substrate with a large arrangement pitch of the recording elements allows to compactize the head without influencing for example a functional element for driving the recording element. In such case, the width of the electrode terminals of the external wiring substrate, corresponding to the recording element substrate with a larger arrangement pitch of the electrodes is increased whereby the engagement with the bumps on the electrode terminals can be made larger even if the components are displaced in position by a fluctuation in the assembling, and the rate of electrical defects can be reduced.

Alignment of higher precision can be achieved since the alignment is executed between the electrodes, arranged with a smaller first arrangement pitch, of the first recording element substrate and the electrode terminals of the external wiring substrate corresponding to such smaller first arrangement pitch. It is thus rendered possible to reduce the defects relating to electrical connection, also to improve the production yield thereby achieving reduction in cost.

A reduction in the arrangement pitch of the electrodes of the recording element substrate with a large arrangement pitch of the recording elements allows to compactize the head without influencing for example a functional element for driving the recording element.

DESCRIPTION OF THE PREFERRED EMBODIMENTS

Now the present invention will be clarified in detail by preferred embodiments thereof, with reference to the accompanying drawings.

FIGS. 1A and 1B to 6 show a head cartridge and an ink tank adapted for use in the ink jet recording head of the present invention, and the relationship thereof. Various components will be explained in the following with reference to these drawings.

Figure 1A:
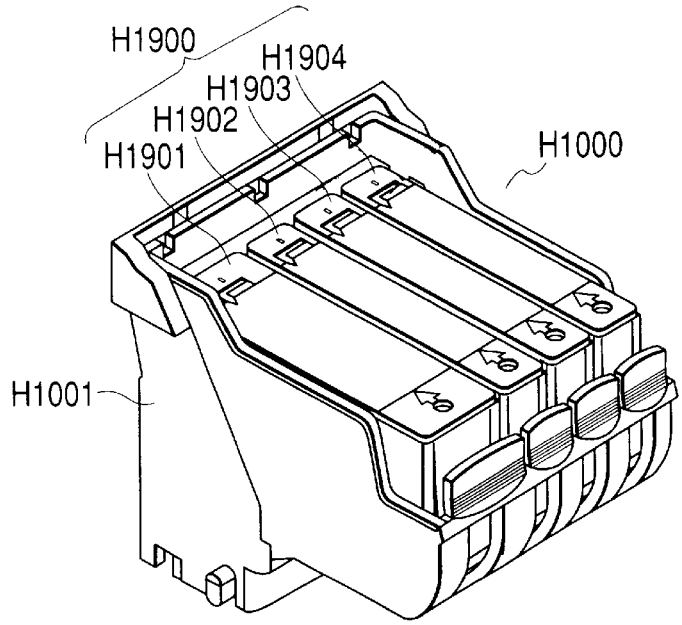
FIGS. 1A and 1B are external perspective views of a recording head cartridge of a first embodiment of the present invention.
Figure 1B:
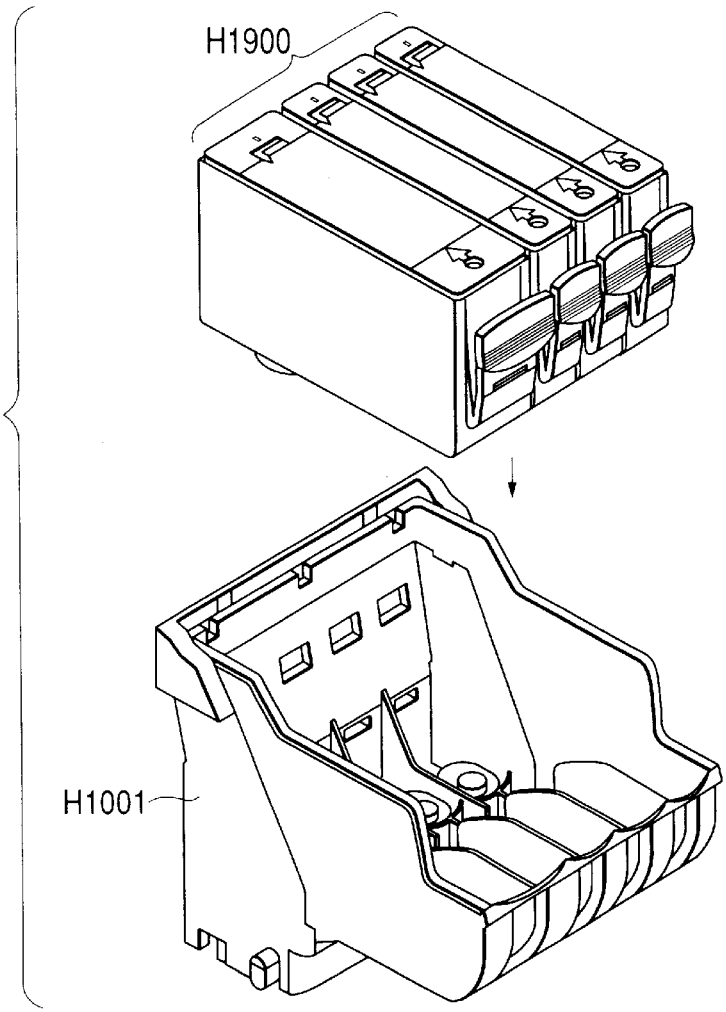

As will be apparent in perspective views in FIGS. 1A and 1B, a recording head H1000 of the present invention is composed of a recording head H1001 and an ink tank H1900 (composed of a black ink tank H1901, a cyan ink tank H1902, a magenta ink tank H1903 and a yellow ink tank H1904) detachably attachable to the recording head H1001. The recording head cartridge H1000 is fixedly supported by positioning means and electrical contacts of a carriage (not shown) provided in the main body of the recording apparatus, and is rendered detachably from the carriage. The black ink tank H1901, cyan ink tank H1902, magenta ink tank H1903 and yellow ink tank H1904 are respectively used for black ink, cyan ink, magenta ink and yellow ink. As these ink tanks H1901, H1902, H1903, H1904 are individually rendered detachable from the recording head H1001 and replaceable, it is possible to replace only the ink tank for which the replacement is necessary, thereby reduce the running cost of printing in the ink jet recording apparatus.

In the following there will be given detailed explanations on the components constituting the recording head H1001.

(1) Recording head

The recording head H1001 of so-called side shooter type, based on a bubble jet method in which recording is executed by an electrothermal converting member for generating thermal energy for generating film boiling in the ink in response to an electrical signal.

Figure 3:
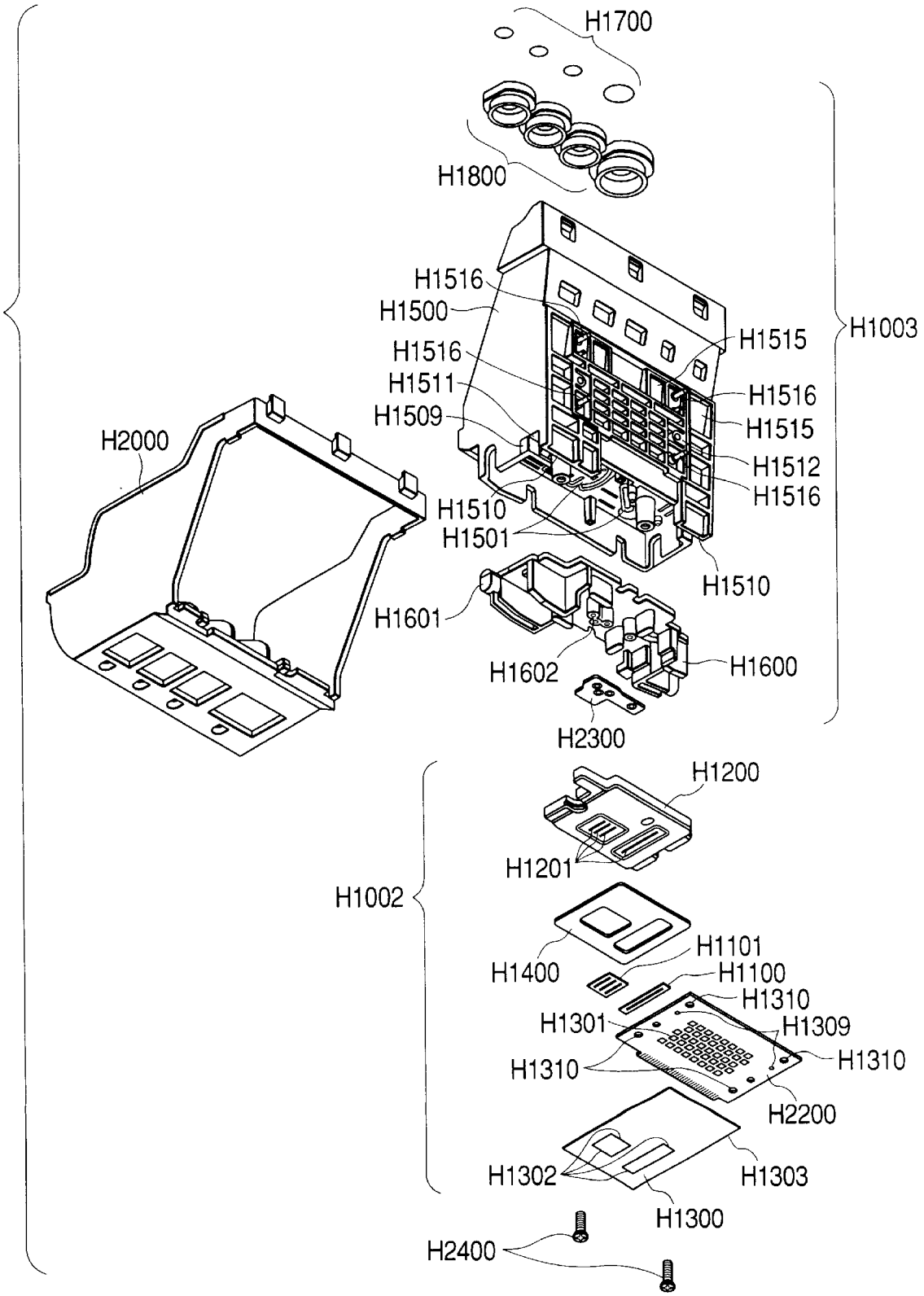
FIG. 3 is an exploded perspective view of an ink supply unit and a recording element unit shown in FIG. 2.

As shown in an exploded perspective view in FIG. 3, the recording head H1000 is composed of a recording element unit H1002, an ink supply unit H1003 and a tank holder H2000.

Also as shown in an exploded perspective view in FIG. 3, the recording element unit H1002 is composed of a first recording element substrate H1100, a second recording element substrate H1101, a first plate H1200, an electrical wiring tape H1300, an electrical contact substrate H2200 and a second plate H1400, while the ink supply unit H1003 is composed of an ink supply member H1500, a flow path forming member H1600, a joint rubber H2300, a filter H1700 and a seal rubber H1800.

(1-1) Recording element unit

Figure 4:
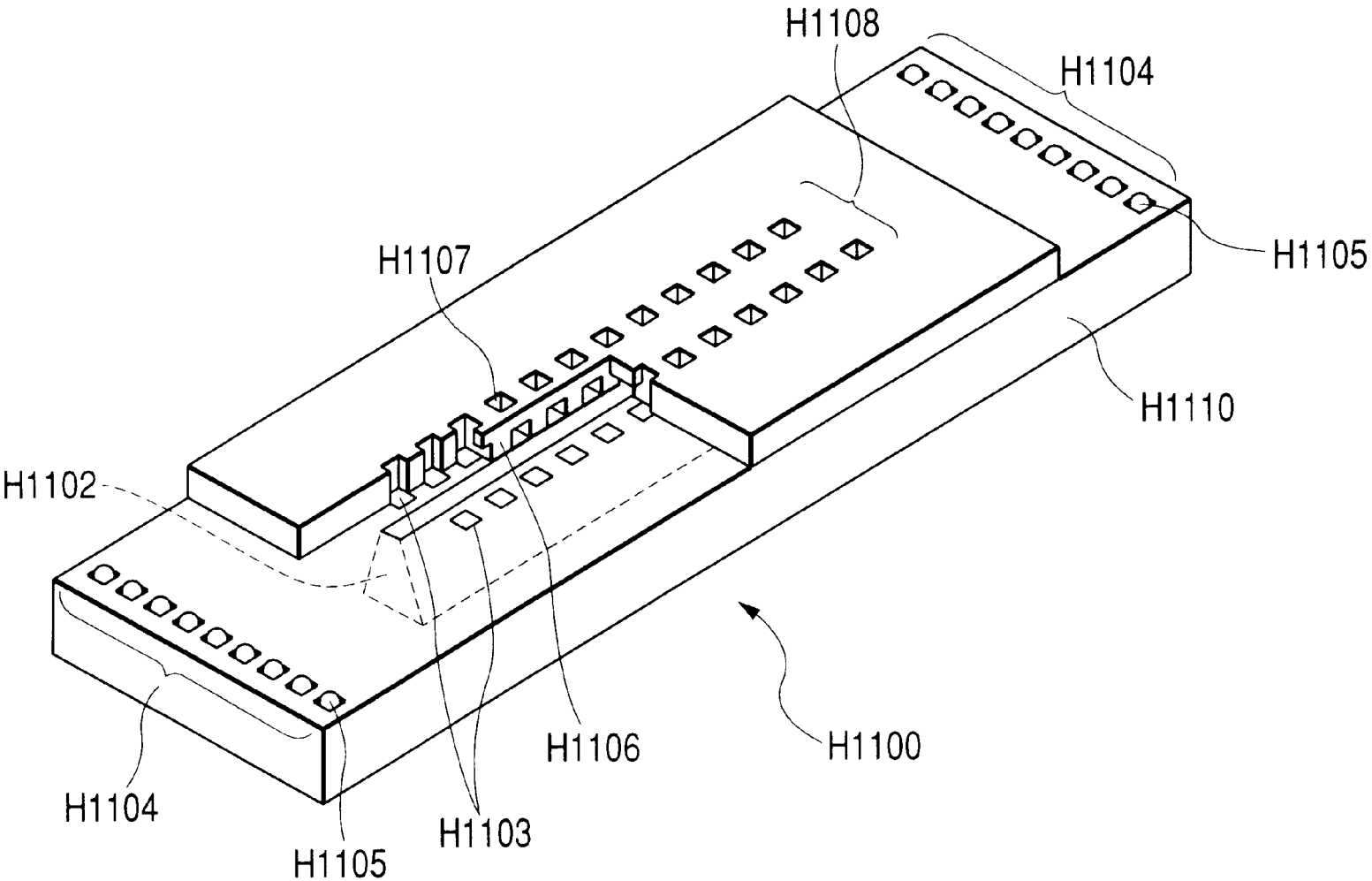
FIG. 4 is a partially broken perspective view of a first recording element substrate shown in FIG. 3.

FIG. 4 is a partially cut-off perspective view showing the configuration of the first recording element substrate H1100.

The first recording element substrate H1100 is provided with a Si substrate H1110 for example of a thickness of 0.5 to 1 mm in which an ink supply aperture H1102 consisting of a long groove-shaped aperture is formed for example by anisotropic etching utilizing the crystalline orientation of silicon or by sand blasting. On both sides of the ink supply aperture H1102, electrothermal converting elements H1103 are arranged in respective linear arrays and in mutually staggered manner, and such electrothermal converting elements H1103 and unrepresented electrical wirings consisting for example of aluminum, for supplying the electrothermal converting elements with electric power, are formed by a film forming process. Electrode portions H1104 for supplying the electrical wirings with electric power are arranged on both outer sides of the electrothermal converting elements H1103 and are provided thereon with bumps H1105 composed for example of Au. On the Si substrate H1110, ink flow path walls H1106 for forming ink flow paths corresponding to the electrothermal converting elements H1103 and discharge openings H1107 are formed with a resinous material through a photolithographic process, whereby a discharge opening group H1108 is formed.

Ink supplied from the ink flow path H1102 is discharged from the discharge opening H1107 opposed to the electrothermal converting element H1103, by a bubble generated by the electrothermal converting element H1103.

Figure 5:
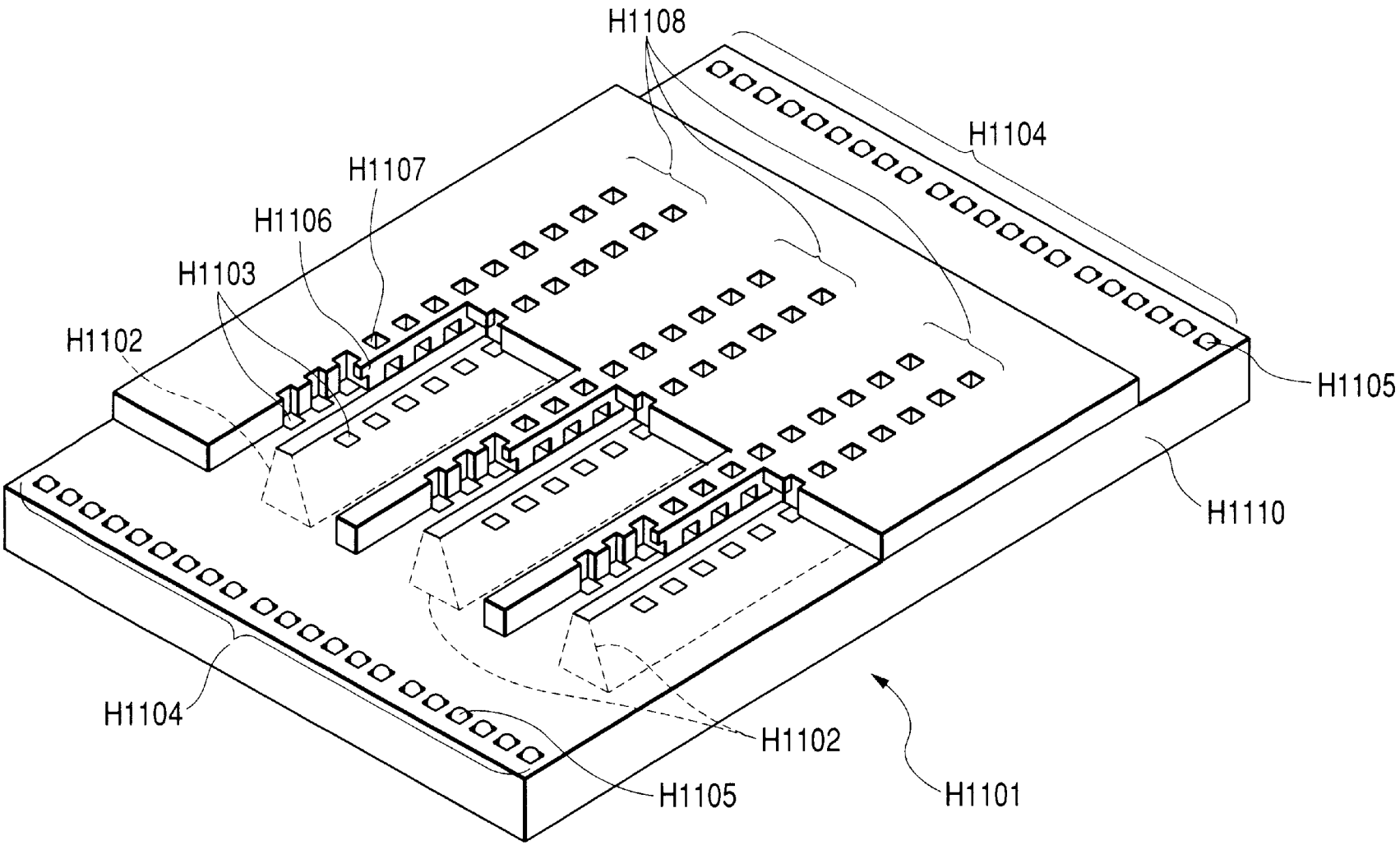
FIG. 5 is a partially broken perspective view of a second recording element substrate shown in FIG. 3.

FIG. 5 is a partially cut-off perspective view showing the configuration of the second recording element substrate H1101.

The second recording element substrate H1101, for discharging inks of cyan, magenta and yellow colors, is provided with three ink supply apertures H1102 in parallel, and, on both sides of each ink supply aperture H1102, electrothermal converting elements H1103 and discharge openings H1107 are formed. As in the first recording element substrate H1100, the Si substrate H11110 is naturally provided with ink supply apertures H1102, electrothermal converting elements H1103, electrical wirings and electrode portions H1104, and ink flow path walls and discharge openings H1107 are formed thereon with a resinous material.

Also as in the first recording element substrate H1100, bumps H1105 composed for example of Au are formed on the electrode portions H1104 for supplying the electrical wirings with electrical power.

In the following there will be given an explanation on the first plate H1200.

The first plate h1200 is composed for example of alumina ($Al_2O_3$) of a thickness of 0.5 to 1.0 mm. The material of the first plate H1200 is not limited to alumina but there may be employed any material having a linear expansion coefficient similar to that of the recording element substrate H1100 and a thermal conduction rate equal to or larger than that of the material constituting the recording element substrate H1100. More specifically, the first plate H1200 may be composed for example of any of silicon (Si), aluminum nitride (AlN), zirconia, boron nitride ($Si_3N_4$), silicon carbide (SiC), molybdenum (Mo) and tungsten (W). The first plate H1200 is provided with an ink supply aperture H1201 for supplying the first recording element substrate H1100 with black ink and ink supply apertures H1201 for supplying the second recording element substrate H1101 with cyan, magenta and yellow inks, and the ink supply apertures H1102 of the first recording element substrate H1100 and the second recording element substrate H1101 respectively correspond to the ink supply apertures H1201 of the first plate H1200, and the first and second recording element substrates H1100, H1100 are respectively adhered and fixed to the first plate H1200 with high positional precision, first adhesive to be employed in adhesion desirably has a low viscosity, a low setting temperature, a short setting time, and, after setting a relatively high hardness and high ink resistance. The first adhesive is for example thermosettable adhesive principally composed of epoxy resin and preferably has a thickness of the adhesion layer not exceeding 50 $\mu$m.

The electrical wiring tape H1300 is used for supplying the first and second recording element substrates H1100, H1101 with electrical signals for causing ink discharge, and is provided with plural apertures for assembling respective recording element substrates, electrode terminals H1302 respectively corresponding to the electrode portions H1104 of the recording element substrates, and electrode terminals portions H1303 for electrical connection with an electrical contact substrate H2200 positioned at an end of the electrical wiring tape H1300 and having external signal input terminals H1301 for receiving electrical signals from the main body of the apparatus, and the electrode terminals H1302 and the electrode terminals H1303 are mutually connected by wiring patterns composed of continuous copper foils.

The electrical wiring tape H1300, the first recording element substrate H1100 and the second recording element substrate H1101 are electrically connected, for example by electrically connecting the bumps H1105 of the electrode portions H1104 of the first recording element substrate H1100 with the corresponding electrode terminals H1302 of the electrical wiring tape H1300 by thermal ultrasonic pressing, and by similarly connecting the bumps H1105 of the electrode portions H1104 of the second recording element substrate H1100 with the corresponding electrode terminals H1302 of the electrical wiring tape H1300 by thermal ultrasonic pressing.

The second plate H1400 is composed of a plateshaped member for example of a thickness of 0.5 to 1 mm, consisting of a ceramic material such as alumina ($Al_2O_3$) or a metal such as Al or SUS, and having apertures larger than the external dimensions of the first and second recording element substrates H1100, H1101 adhered to the first plate H1200. The second plate H1400 is adhered to the first plate H1200 by second adhesive material in such a manner that the first and second recording element substrates H1100, H1101 and the electrical wiring tape H1300 can be electrically connected in planar manner, and the rear surface of the electrical wiring tape H1300 is adhered by a third adhesive material.

The electrical connecting portions of the first and second recording element substrates H1100, H1101 and the electrical wiring tape H1300 are sealed by first sealant H1307 and second sealant H1308 (cf. FIG. 10), thereby being protected from corrosion by ink or from external shock. The first sealant H1307 principally seals the rear side of the connecting portion between the electrode portions H1302 of the electrical wiring tape H1300 and the bumps H1105 of the recording element substrate and the external peripheral portion of the recording element substrate, while the second sealant H1308 seals the front side of the above-mentioned connecting portion.

Also at an end of the electrical wiring tape H1300, there is electrically connected the electrical contact substrate H2200, having the external signal input terminals h1301 for receiving the electrical signals from the main body of the apparatus, for example by thermal pressing utilizing an anisotropic conductive film.

The electrical wiring tape H1300 is folded at a side of the first plate H1200 and adhered to a side face thereof by the third adhesive H1306. The third adhesive H1306 can be composed for example of thermosettable adhesive principally composed of epoxy resin and having a thickness of 10 to 100 $\mu$m.

(1-2) Ink Supply Unit

The ink supply member H1500 is formed for example by resin molding. The resinous material preferably contains glass fillers in an amount of 5 to 50% in order to improve rigidity in shape.

Figure 6:
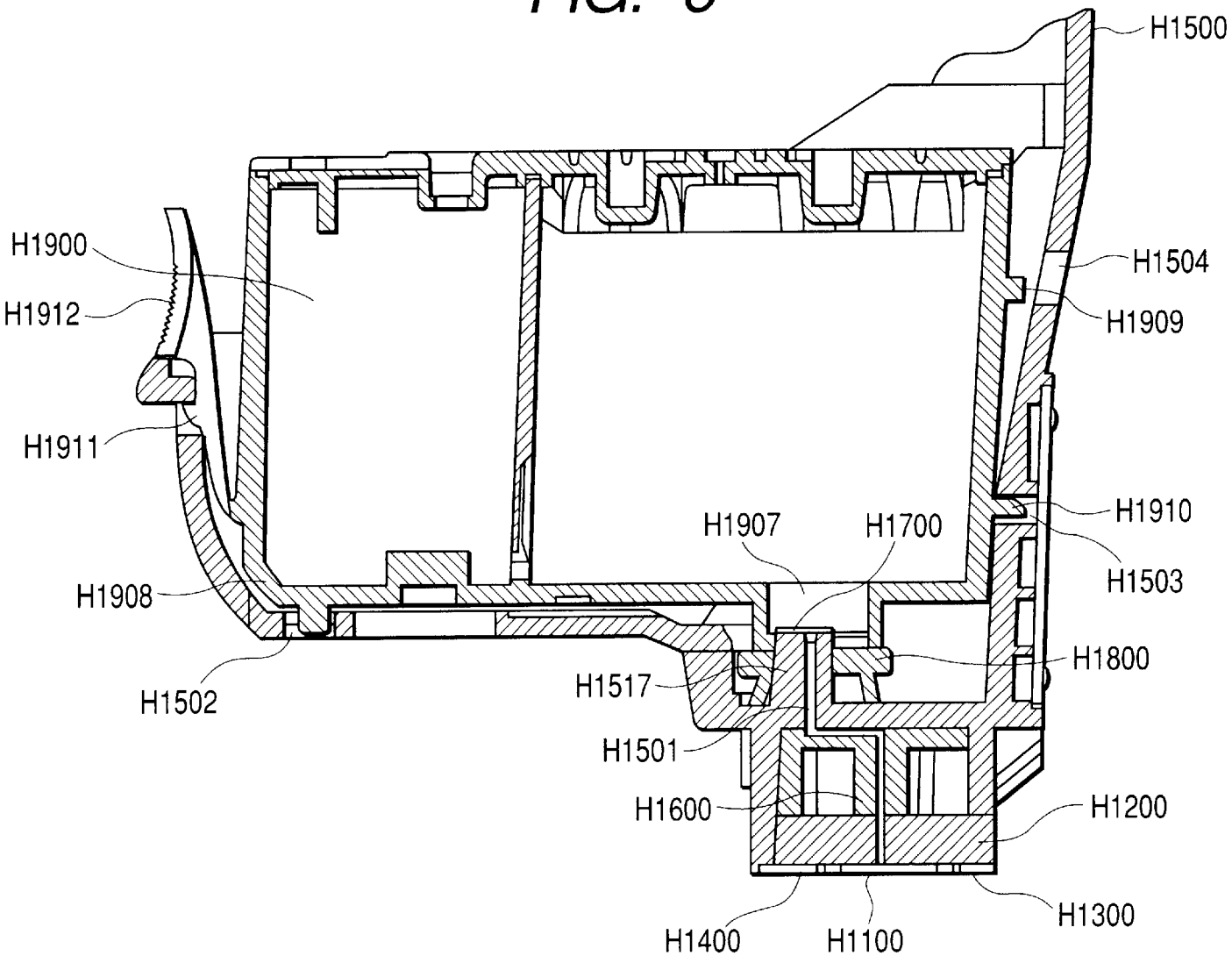
FIG. 6 is a lateral cross-sectional view of a recording head cartridge shown in FIGS. 1A and 1B.

As shown in FIGS. 3 and 6, the ink supply member H1500 is a component constituting the ink supply unit H1003 for guiding ink from the ink tank H1900 to the recording element unit H1002, and ink flow paths H1501 are formed by ultrasonic fusion of the flow path forming members H1600. In a joint H1517 engaging with the ink tank H1900, there is jointed by fusion a filter H1700 for preventing dust entry from the exterior, and a seal rubber H1800 is mounted in order to prevent ink evaporation from the joint portion H1517.

The ink supply member H1500 is also provided a function of holding the detachable ink tank H1900, and is provided with a first hole H1503 for engaging with a second claw H1910 of the ink tank H1900. It is further provided with a mounting guide H1601 for guiding the recording head cartridge H1000 to a mounting position on the carriage of the main body of the ink jet recording apparatus, an engaging portion for mounting and fixing the recording head cartridge H1000 on the carriage by a headset lever, and impingement portions H1509, H1510, H1511 respectively in the X direction (scanning direction of the carriage), Y direction (conveying direction of the recording medium) and Z direction (ink discharge direction) for positioning in the predetermined mounting position on the carriage. There is further provided a terminal fixing portion H1512 for positioning and fixing the electrical contact substrate H2200 of the recording element unit H1002, and plural ribs are formed on the terminal fixing portion H1512 and in the vicinity thereof, in order to increase the rigidity of the surface having the terminal fixing portion H1512.

(1-3) Coupling of Recording Head Unit and Ink Supply unit

Figure 2:
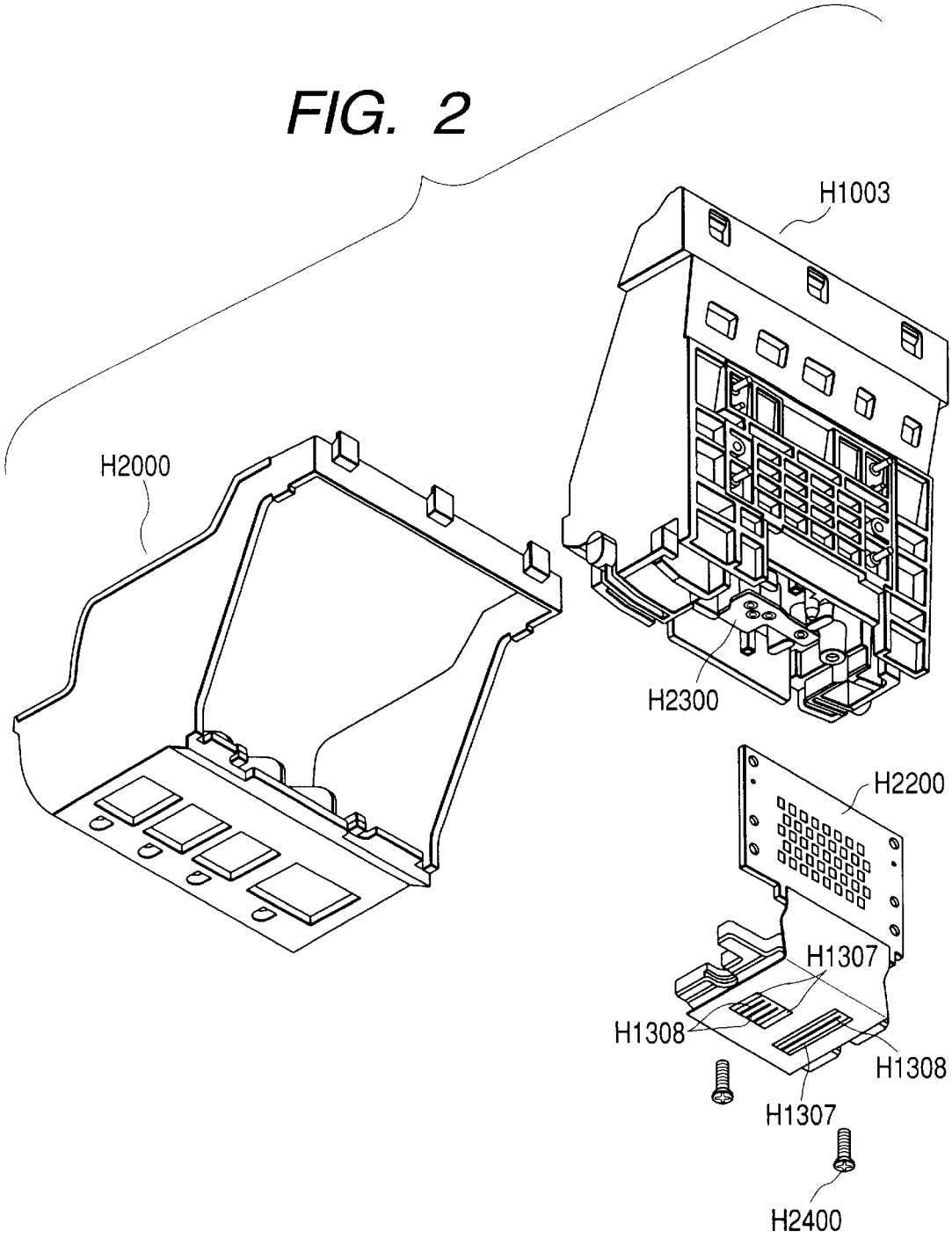
FIG. 2 is an exploded perspective view of the recording head cartridge shown in FIGS. 1A and 1B.

As shown in FIG. 2, the recording head H1001 is completed by coupling the recording element unit H1002 to the ink supply unit H1003 and then coupling to the tank holder H2000. Such coupling is executed in the following manner.

In order to achieve communication, without ink leakage, of the ink supply aperture of the recording element unit H1002 (namely the ink supply aperture H1201 of the first plate H1200) and the ink supply aperture of the ink supply unit H1003 (namely the ink supply aperture H1602 of the flow path forming member H1600), these members are mutually pressed across the joint rubber H2300 and are fixed with screws H2400. At the same time, in this operation, the recording element unit H1002 is precisely aligned and fixed with respect to the reference positions in the X, Y and Z directions of the ink supply unit H1003.

Figure 7:
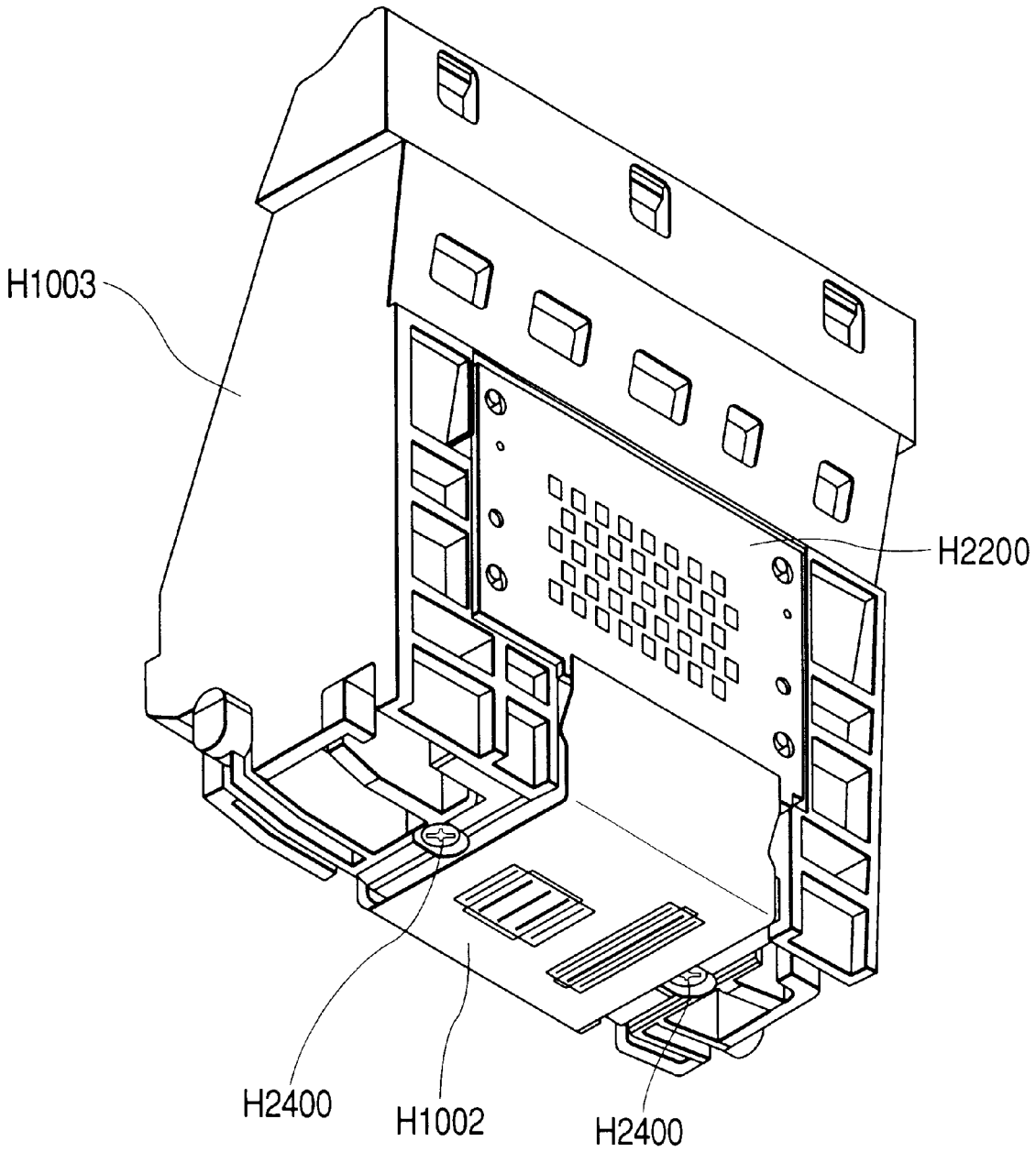
FIG. 7 is a perspective view showing a state in which the recording element unit is assembled to the ink supply unit.
Figure 8:
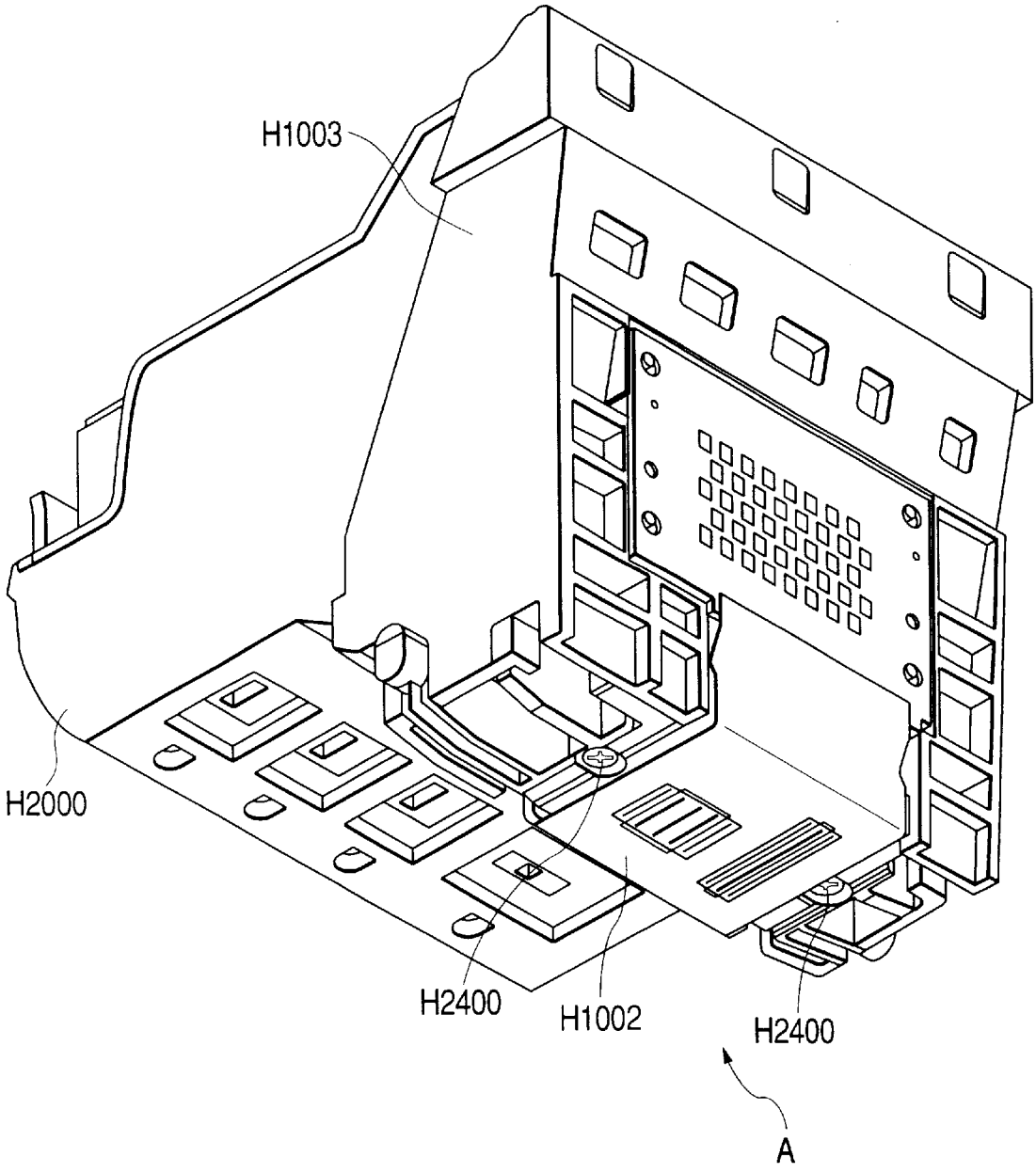
FIG. 8 is a perspective view showing a recording head completed by assembling the ink supply unit and the recording element unit to a tank holder.

The electrical contact substrate H2200 of the recording element unit H1002 is positioned and fixed, on a lateral face of the ink supply member H1500, by terminal positioning pins H1515 (in two positions) and terminal positioning holes H1309 (in two positions). The fixing is achieved for example by caulking the terminal coupling pins H1515 provided on the ink supply member H1500, but other fixing means may be employed for this purpose. FIG. 7 shows a state in which the recording element unit h1002 is thus assembled to the ink supply unit H1003. The recording head H1001 is completed by coupling holes and coupling members of the ink supply member H1500 and the tank holder H2000. FIG. 8 shows a recording head H1001 completed by assembling the ink supply unit H1003 and the recording element unit H1002 to the tank holder H2000.

(2) Explanation on Recording Head Cartridge

As shown in FIGS. 1A and 1B, the black ink tank H1901, cyan ink tank H1902, magenta ink tank H1903 and yellow ink tank H1904 mounted on the recording head H1001 constituting the recording head cartridge H1000 contain inks of respective colors. Also as shown in FIG. 6, the ink tank H1901, H1902, H1903, H1904 are provided with ink supply apertures H1907 for supplying the recording head H1001 with the respective inks in such ink tanks. For example, when the ink tank H1901 is mounted on the recording head H1001, the ink supply aperture H1907 of the black ink tank H1901 is pressed to the filter H1700 provided in the joint H1517 of the recording head H1001, whereby the black ink in the black ink tank H1901 is supplied, from the ink supply aperture H1907, then through the ink flow path H1501 of the recording head H1001 and the first plate H1200 to the first recording element substrate H1100.

Then the ink is supplied to an unrepresented bubble forming chamber provided with the electrothermal converting element H1103 and the discharge opening H1107, and is discharged toward a recording sheet by thermal energy generated by the electrothermal converting element H1103.

EXAMPLE 1

Figure 9:
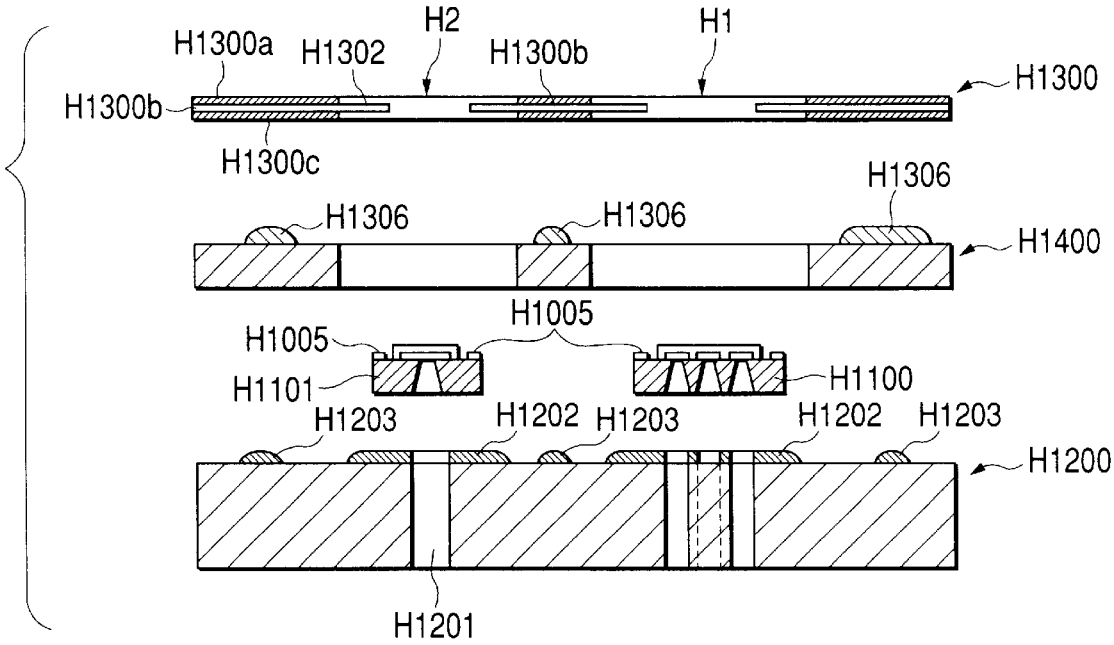
FIG. 9 is a schematic exploded cross-sectional view of the recording element unit in an example 1 of the present invention.
Figure 10:
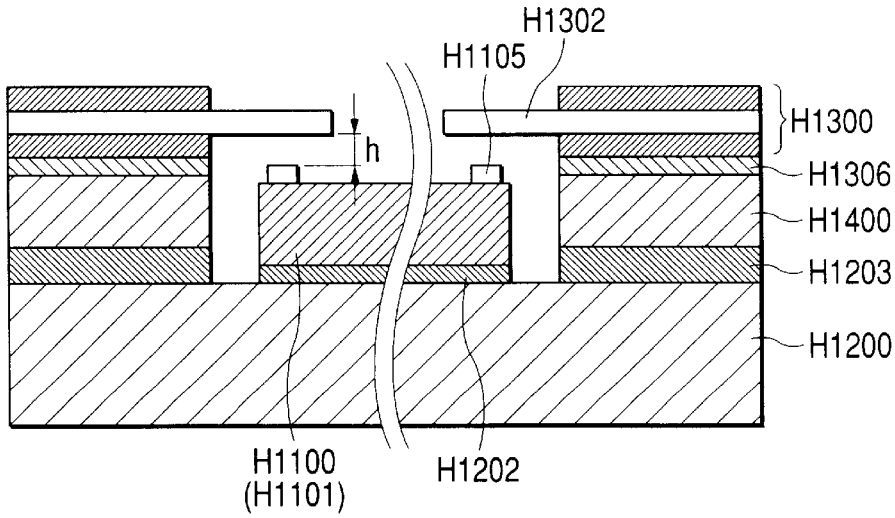
FIG. 10 is a schematic magnified cross-sectional view of the recording element unit in the example 1 of the present invention.

Now an example 1 of the present invention will be explained with reference to FIGS. 9 to 12, in which FIG. 9 is a partially exploded schematic cross-sectional view of the recording element unit H1002 and FIG. 10 is a schematic cross-sectional view thereof.

As shown in FIG. 9, the electrical wiring tape H1300 has a three-layered structure in the vicinity of the bonding area, namely consisting of a polyimide base film H1300*a* at the top side, a copper foil H1300*b* in the middle and a solder resist H1300*c* at the rear side. The electrical wiring tape H1300 is provided with a device hole (aperture) H1 in which the first recording element substrate H1100 is inserted and a device hole H2 in which the second recording element substrate H1101 is inserted, and there are exposed gold-plated inner leads (electrode leads) H1302 to be connected with the bumps H1005 of the recording element substrates H1100, H1101.

In the following there will be explained, with reference to FIGS. 9 and 10, steps of a method for producing the recording element unit, according to the producing method for the ink jet recording head of the present invention.

At first the second plate H1400 is adhered to the first plate H1200 by a second adhesive layer H1203, of which thickness is limited to 0.06 mm or less, as in the conventional technology, in order that the first recording element substrate H1100, the second recording element substrate H1101 and the electrical wiring tape H1300 can be electrically connected in planar manner. In the present example, the adhesion of the second plate H1400 to the first plate H1200 may be executed before or after the adhesion of the recording element substrates H1100, H1100.

Then the first adhesive layer H1202 for adhering the first recording element substrate H1100 and the second recording element substrate H1101 is formed by coating on the first plate H1200, and the recording element substrates H1100, H1101 are fixed by pressing under alignment of the relative positional relationship of the plural elecctrothermal converting elements H1103 or the discharge openings for discharging the recording liquid along the plane of wirings. In this operation, highly precise adhesion can be realized in stable manner, since the operation, different from the aforementioned conventional process, is not affected for example by the reduction in the contact area of the pressing head or the contact with the adhesive material of the electrical wiring tape.

Then a third adhesive layer H1306 for adhering the rear surface of the electrical wiring tape H1300 is formed by coating on the second plate H1400, and the electrodes H1104 of the recording element substrates H1100, H1100 are fixed by pressing to the electrodes leads H1302 of the electrical wiring tape H1300 under mutual alignment. Thereafter the bumps H1105 on the electrodes H1104 of the recording element substrates and the electrode leads H1302 of the electrical wiring tape H1300 are electrically jointed one by one by thermal ultrasonic pressing. The electrical jointing by thermal ultrasonic pressing is frequently employed in wire bonding, and, being metal—metal jointing, has high reliability of the jointed portion and high productivity. Also with respect to the positional relationship in the vertical direction between the bumps H1105 on the elecctrodes H1104 of the recording element substrate and the electrode leads H1302 of the electrical wiring tape H1300, the fluctuation in height can be absorbed by the electrode leads H1302 of the electrical wiring tape H1300, so that there can be provided an ink jet recording head of high reliability.

Then the joint portions of the bumps H1105 on the electrodes H1104 or the recording element substrate H1100 and the electrode leads H1302 of the electrical wiring tape H1300 are sealed with resin to prevent shortcircuiting for example by ink.

The thermal ultrasonic pressing method employed in the present example, though being jointing one by one, allows production within a short time since the number of wirings in the ink jet recording head is 20 to 100 per recording element substrate and the jointing can be realized in 0.1 to 0.2 seconds per joint.

Figure 11:
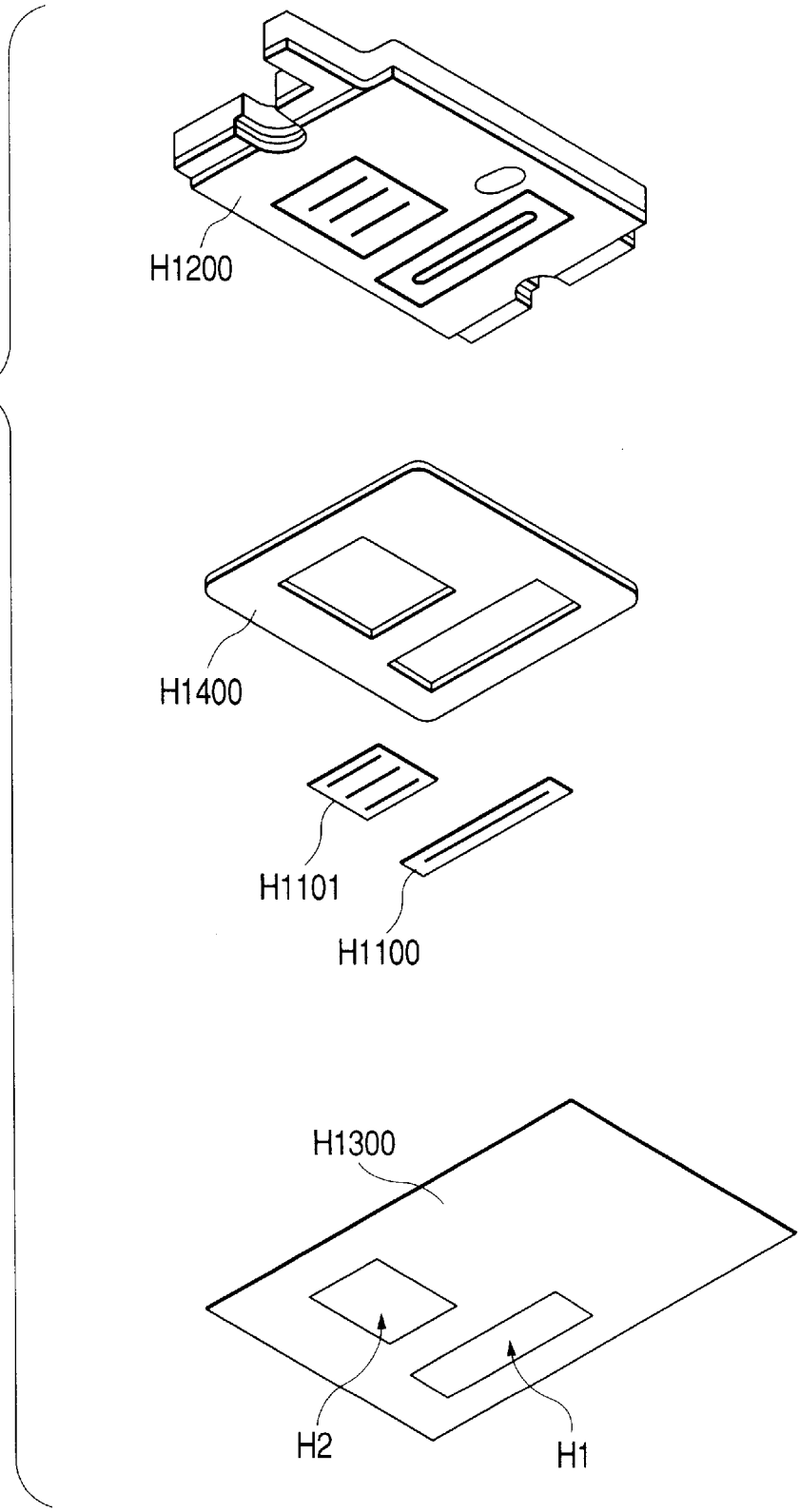
FIG. 11 is a schematic magnified and exploded perspective view of the recording element unit in the example 1 of the present invention.

FIG. 11 is a magnified exploded perspective view of the first and second plates H1200, H1400, the first and second recording element substrates H1100, H1101 and the electrical wiring tape H1300 shown in FIG. 3. Now the configuration of the present example will be explained in more details with reference to FIGS. 9 to 11.

In the present example, the first plate H1200 is composed of alumina with a thickness of 4±0.03 mm, while the second plate H1400 is also composed of alumina with a thickness of 0.67±0.05 mm, and the first and second recording element substrates H1100, H1101 have a thickness of 0.625±0.025 mm. As explained in the foregoing, the electrical wiring tape (flexible printed circuit board) H1300 has a three-layered structure consisting of the base film, copper foil wiring and solder resist, and is provided with the device holes H1, H2 in which the gold-plated electrode leads H1302 are exposed.

The second plate H1400 in the present example is a single plate-shaped member, is provided with two holes for inserting the recording element substrates H1100, H1101 and is fixed by adhesion to the first plate H1200. Also the electrical wiring tape H1300 is adhered by the third adhesive layer H1306 to the second plate H1400, over the entire area except for the device holes H1, H2 provided for exposing the recording element substrates H1100, H1101.

FIG. 10 is a cross-sectional view of the first plate H1200, the first recording element substrate H1100 (or second recording element substrate H1101), the second plate H1400 and the electrical wiring tape H1300 in a state where they are fixed in a laminar structure. In the present example, the first adhesive layer H1202 has a thickness of 0.05±0.004 mm, while the second adhesive layer H1203 has a thickness of 0.02±0.005 mm, and the third adhesive layer H1306 has a thickness of 0.02±0.005 mm, and the components are mutually adhered by these adhesive layers. Also the solder resist of the electrical wiring tape H1300 has a thickness of 0.017±0.0125 mm, and the bumpts H1105 has a height of 0.0325±0.0075 mm. Thus the gap h between the upper surface of the bumps H1105 and the electrode leads H1302 in FIG. 10 is 0.075 mm, and in consideration of various tolerances the tolerance range is ±0.085 mm which is within the gap range acceptable in the ordinary thermal ultrasonic pressing method. Consequently the bumps H1105 and the electrode leads H1302 can be easily jointed by the thermal ultrasonic pressing (inner lead bonding).

The support members (plates), recording element substrates and electrical wiring tape (flexible printed circuit board) of the aforementioned configuration allow to improve the reliability of the inner lead bonding, thereby realizing secure electrical connection.

(Electrical Connecting Portion)

Figure 12:
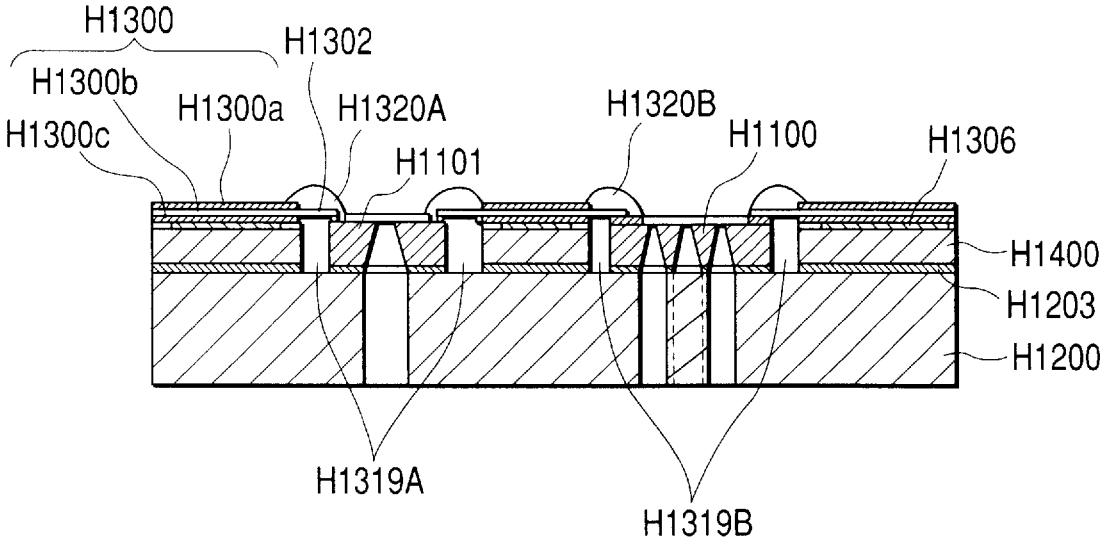
FIG. 12 is a cross-sectional view of the recording element unit in the example 1 of the present invention.
Figure 13:
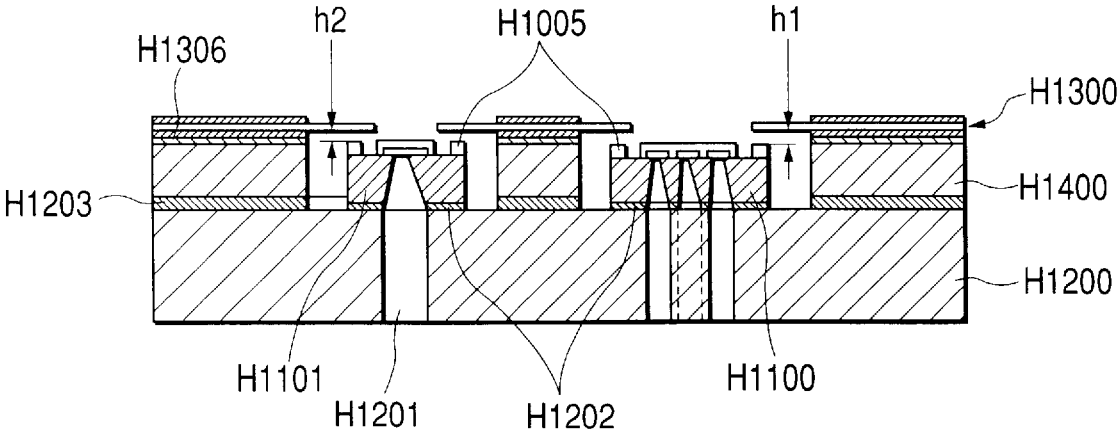
FIG. 13 is a cross-sectional view of the recording element unit in an example 2 of the present invention.
Figure 14:
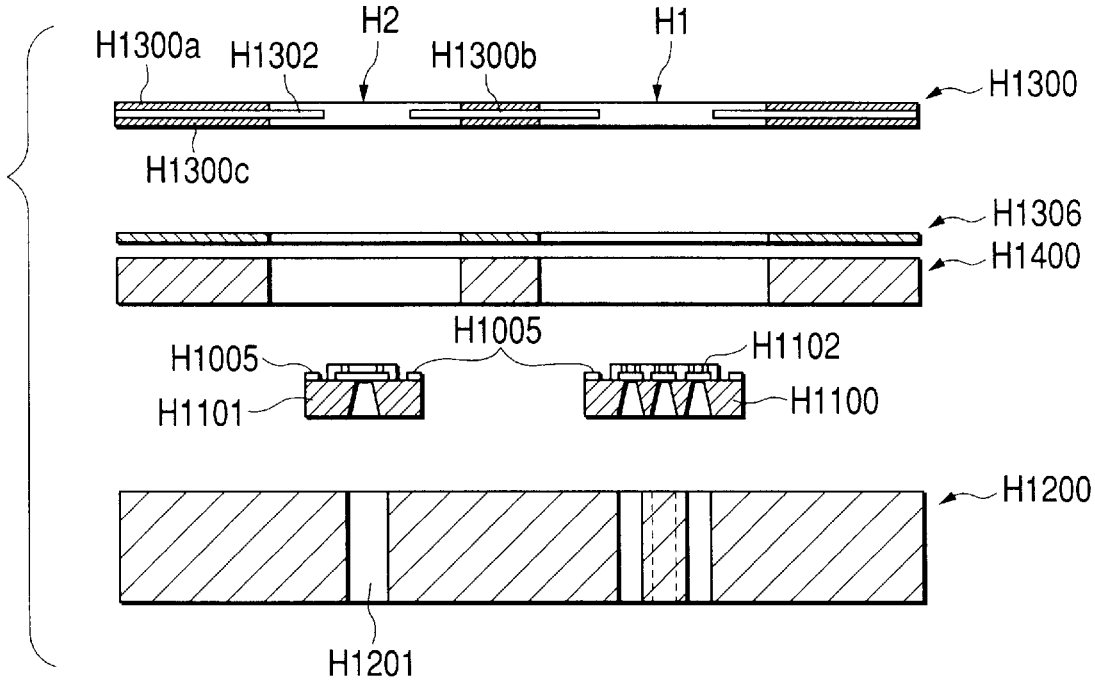
FIG. 14 is an exploded cross-sectional view of the recording element unit in the example 2 of the present invention.

Now there will be explained, with reference to FIG. 12, the sealing method around the electrical connecting portion.

In the electrically jointed state by the aforementioned thermal ultrasonic pressing, the portions of the electrodes H1104 of the recording element substrate and the electrode leads H1302 of the electrical wiring tape H1300 are exposed. Therefore, gaps H1319A, H1319B under the electrode leads H1302 and gaps H1320A, H1320B thereon are hermetically sealed by a sealant. The reliability of the sealing operation can be ensured since the electrode leads H1302 of the electrical wiring tape H1300 are comb tooth-shaped to allow easy air escaping.

Figure 25:
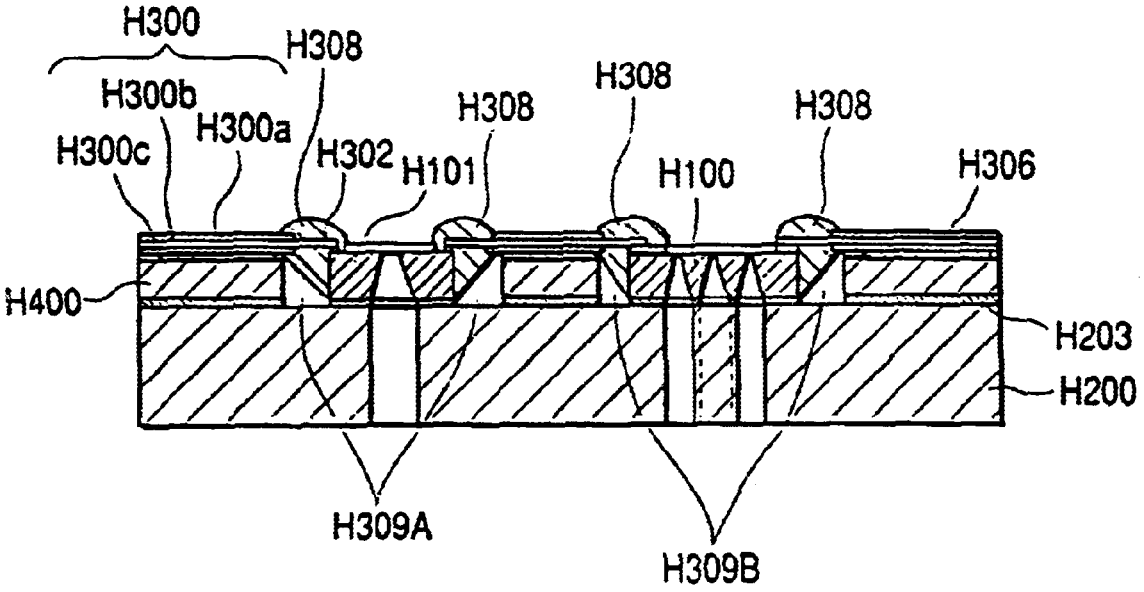
FIG. 25 is a schematic cross-sectional view of a conventional recording element unit.

In case of the conventional TAB mounting process in which, as shown in FIG. 25, the leads (electrode terminals) of the electrical wiring tape are electrically jointed in advance to the bumps on the electrode pads of the recording element by thermal ultrasonic pressing method and the electrical wiring tape is then adhered to the support member after the sealing operation, gaps H309A, H309B remain under the sealant H308 even in a state where the TAB units H300U1, H300U2 are assembled and it is required to further introduce sealant (not shown) in order to prevent intrusion of the inks into such gaps. In these gap portions, easy air escaping is difficult because the upper parts are already sealed, and there may result air trapping, eventually leading to a defect such as a hole formation by the expansion of the trapped air for example in case of using a thermosetting epoxy sealant.

On the other hand, in the present example, the members present in a portion to be sealed are at first aligned and jointed, and are collectively sealed at last, so that the manufacture can be realized in stable manner without excessiveness or deficiency of the sealant.

The sealant for the electrical joints need not be same as that for the peripheral portion of the recording element substrate. For example, for the gaps H1320A, H1320B on the electrode leads h1302 of the electrical wiring tape H1300, there is preferred a hard epoxy sealant since it may be scraped by a wiper member for wiping off the inks.

Also, the areas around the apertures (device holes) H1, H2 of the electrical wiring tape H1300 constitute capping areas for capping in order to prevent evaporation of the ink in the nozzles, and stable capping areas can be secured since the recording element substrates H1100, H1101 are aligned with the electrical wiring tape H1300 and are then adhered to the second plate h1400 by the third adhesive layer H1306.

In the ink jet recording apparatus of the present example, since the black head and the color head are integrated by assembling to the same wiring substrate, it is unnecessary to correct the landing positions of the inks of the respective heads.

In case of mounting different elements on a single TAB tape as in the aforementioned conventional example, the positional precision inevitably has a fluctuation in the order of 0.1 mm by the bonding precision to the TAB tape and the deformation at the succeeding sealing operation and such conventional method is therefore not usable in the ink jet recording apparatus. On the other hand, the present example allows to secure the mutual positional precision of the elements. Also in the color head of the present example, the color head having nozzles of three colors is different in the external dimension from the black head, but, by assembling the plural recording element substrates of different dimensions into a single flexible wiring substrate, it is rendered possible to compactize the capping means etc., thereby compactizing the recording apparatus itself. Also there exists only one flexible wiring substrate constituting the capping surface, it is rendered possible to securely remove the excessive ink deposited on the nozzle surface or on the flexible wiring substrate, thereby providing an ink jet recording head of a long service life.

EXAMPLE 2

The present example is similar in configuration to the example 1, but is different in that the position of the upper surface of the second plate H1400 is 0.72±0.05 mm and the gap h1 between the bumps H1005 and the electrode leads H1302 is 0.105±0.112 mm. Such fluctuations are ±0.058 mm in summed square and are within a gap range ordinarily acceptable in the thermal ultrasonic pressing (150 μm or less) even if the gap h1 between the bumps H1005 on the recording element substrate H1100 and the electrode leads H1302 is different from the gap h2 between the bumps H1005 on the recording element substrate H1101 and the electrode leads H1302, thus allowing secure metal—metal bonding.

As explained in the foregoing, a reliable and inexpensive ink jet recording head can be producted by at first fixing the plural recording element substrates to a single support member and then executing thermal ultrasonic pressing (inner lead bonding) of the TAB tape.

In the present example, the electrical wiring tape H1300 and the second plate H1400 are adhered by heat pressing, utilizing an adhesion sheet consisting of thermosetting resin as the third adhesive layer H1306, but it is also possible, as in the example 1, to employ non sheet-shaped adhesive.

EXAMPLE 3

Figure 15:
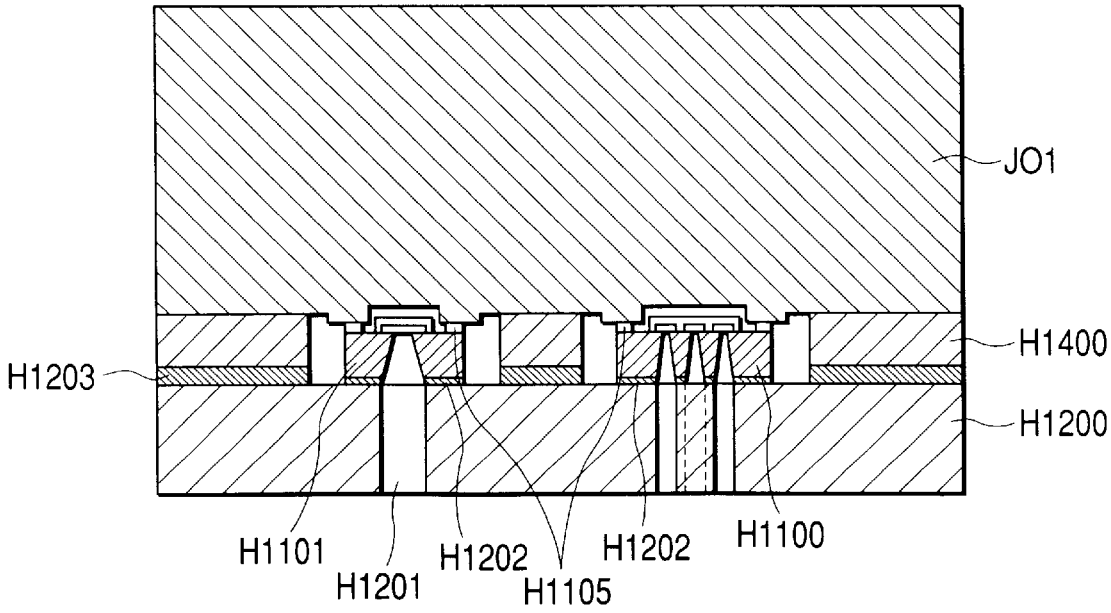
FIG. 15 is a cross-sectional view showing steps for producing the recording element unit in an example 3 of the present invention.
Figure 16:
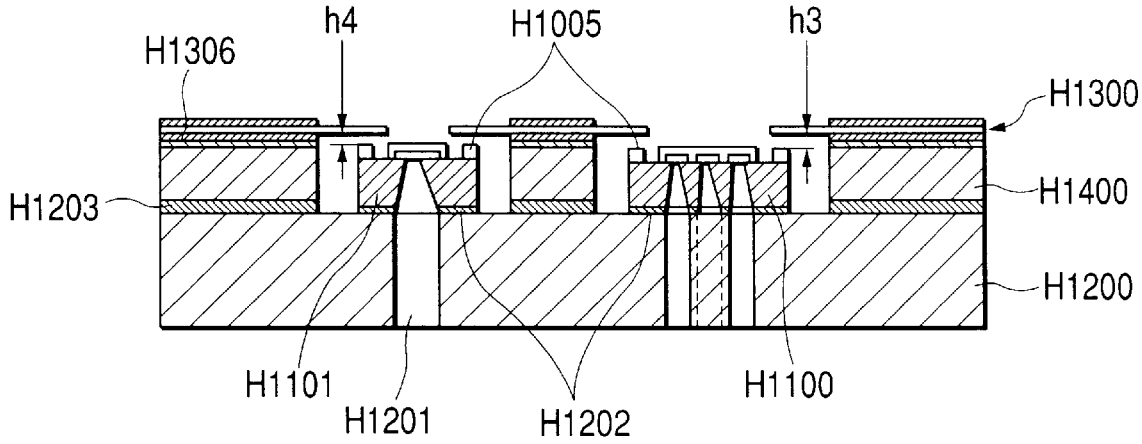
FIG. 16 is a cross-sectional view of the recording element unit in the example 3 of the present invention.

In the present example, as shown in FIGS. 15 and 16, the position of the adhesion plane between the second plate H1400 and the electrical wiring tape H1300 is determined by a jig J01 with an error of ±0.05 mm, taking the top position of the bumps H1105 as reference, in order to achieve adhesion with the adhesive. Thus the gap h3 between the bumps H1005 and the electrode leads H1302 becomes 0.105±0.0625 mm (±0.052 mm in summed square), resulting in a significant decrease in the fluctuation. Consequently it is rendered possible not only to achieve secure metal—metal bonding but also to suppress the fluctuation in the filling amount of the sealant, resulting from the fluctuation in the height of the electrode leads H1302 or in the thickness of the second plate H1400 (for example a reduction in the difference between the gaps h3 and h4). It is also possible to reduce the distance between the discharge openings H1107 and the recording medium.

It is also possible to select the pressing load of the jog J01 onto the bumps H1005 as 1.2 N per bump (namely 12N for 100 bumps), thereby suppressing the fluctuation in the upper surface of the bumps H1005 to ±0.002 mm and improving the planarity. In such case, the gap h3 between the bumps H1005 and the electrode leads H1302 becomes 0.105±0.0425 mm (±0.033 mm in summed square), resulting in a further decrease in the fluctuation.

Figure 17:
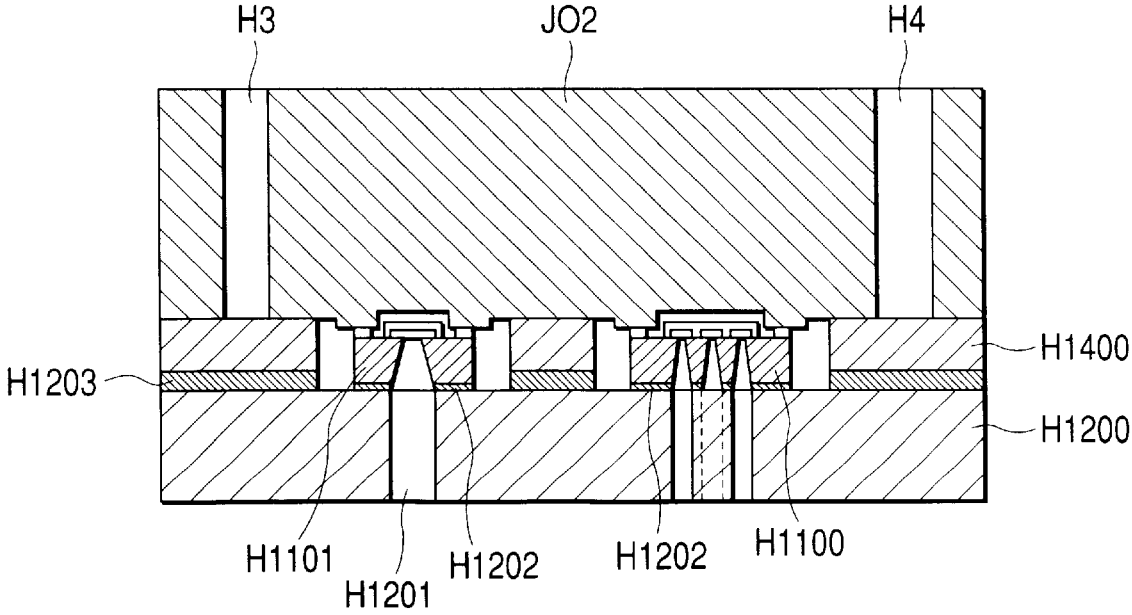
FIG. 17 is a cross-sectional view showing steps for producing the recording element unit in a variation of the example 3 of the present invention.

Also as shown in FIG. 17, a jig J02 is provided with suction apertures H3, H4 and the position of the adhesion plane between the second plate H1400 and the electrical wiring tape H1300 is determined under suction by the jig J02 with an error of ±0.01 mm, taking the top position of the bumps H1105 as reference, and the adhesion is achieved by injecting silicone sealant adhesive into the gap between the first plate H1200 and the second plate H1400. Thus the gap h3 between the bumps H1005 and the electrode leads H1302 becomes 0.105±0.0225 mm (±0.016 mm in summed square), resulting in a further significant decrease in the fluctuation.

Consequently it is rendered possible to reduce the center value of the dimension of the gap H3 between the bumps H1005 and the electrode leads H1302 from 0.105 mm to about 0.03 mm, thereby further reducing the distance between the discharge openings and the recording medium.

In the present example, there is employed a wiring substrate of two-side type and the contact portions with the main body of the printer are provided on a side opposite to the recording element substrate, but, also with a wiring substrate of one-side type, the recording head can be produced by employing another two-side wiring substrate as disclosed in the Japanese Patent Application Laid-open No. 11-138814.

EXAMPLE 4

In the example 1, the bumps H1105 for example of Au are formed by thermal ultrasonic pressing on the electrodes H1104 of the first and second recording element substrates H1100, H1101, but the metal—metal bonding is not limited to such case, and stable bonding can be realized also by increasing the volume of the electrodes for example by plating utilizing heat. Also the example 1 employs a TAB tape having the electrode leads H1302 as the electrical wiring tape H1300, but it is also possible to position and adhere an electrical wiring tape with electrode terminals in a position distant by several hundred micrometers instead of on the electrodes H1104 of the recording element substrate H1101 and then to execute metal—metal bonding by thermal ultrasonic pressing utilizing a wire bonding method with an Au wire or the like.

Figure 18:
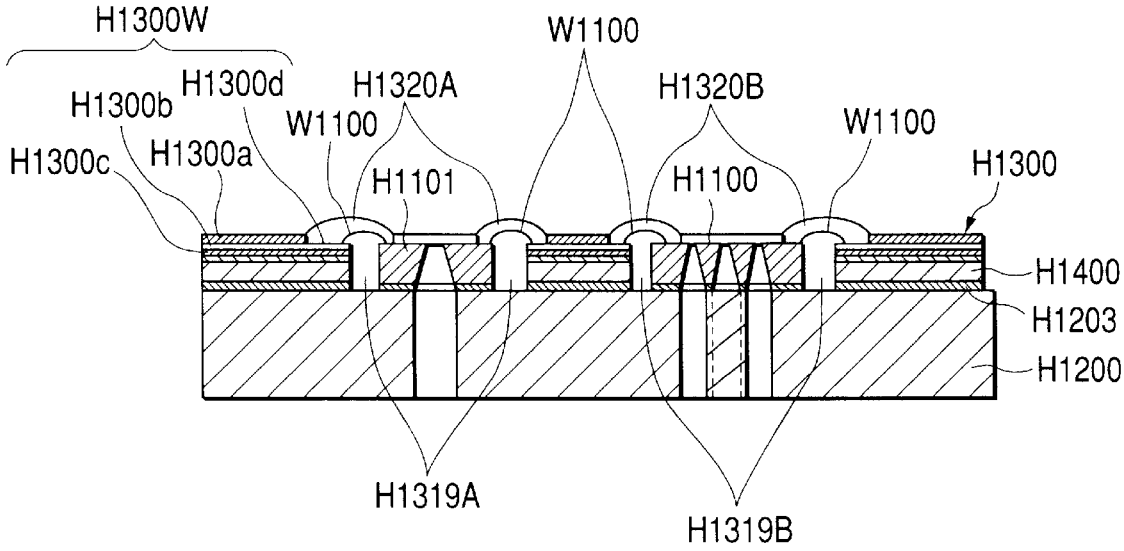
FIG. 18 is a cross-sectional view of the recording element unit in an example 4 of the present invention.

FIG. 18 shows an example of the wire bonding method, in which an electrical wiring tape H1300W has, as in the first example, a three-layered structure in the vicinity of the bonding portion, consisting of a base film H1300*a*, a copper foil H1300*b* and a solder resist H1300*c* on the rear surface, and electrode portions H1300*d* of the copper foil H1300*b* are gold plated and exposed. The adhesion steps of the components are similar to those in the aforementioned example 1, but the electrode portions H1300*d* of the copper foil H1300*b* of the electrical wiring tape H1300W are not positioned on the electrode H1104 of the recording element substrate h1101 as in the example 1 but are distanced by several hundred micrometers and adhered on the second plate H1400.

In the present example, the electrodes H1104 of the first and second recording element substrates H1100, H1101 and the electrode portions H1300*d* of the copper foil H1300*b* of the electrical wiring tape H1300W are wire bonded with binding wires W1100 such as Au wires and then the sealing with resin is executed as in the example 1.

In the ordinary wire bonding apparatus, the positioning of the electrical wiring tape need not be highly accurate since the thermal ultrasonic pressing is executed after recognizing and correcting the positions of the electrode portions, but, in case of the ink jet recording head, the ink landing position becomes displaced unless the height of the bonding wire is reduced. The height of the bonding wire is larger in a first bonding position and fluctuates if the bonding distance fluctuates. In the present example, therefore, as in the example 1, the electrical wiring tape H1300W is positioned precisely with reference to the electrodes H1104 of the first and second recording element substrates H1100, H1100 to stabilize the loop heights of the bonding wires W1100, also the thickness of the second plate H1400 for adhering the electrical wiring tape H1300W is made smaller than in the example 1, and the wire bonding is executed from the electrode portions H1300*d* of the electrical wiring tape H1300W to the electrode portions H1104 of the first and second recording element substrates H1100, H1101.

The present example dispenses with the formation of the bumps H1105 such as of Au by thermal ultrasonic pressing on the electrode portions H1104, thereby enabling manufacture of an inexpensive ink jet recording head of high quality with accurate ink landing position.

EXAMPLE 5

Figure 19:
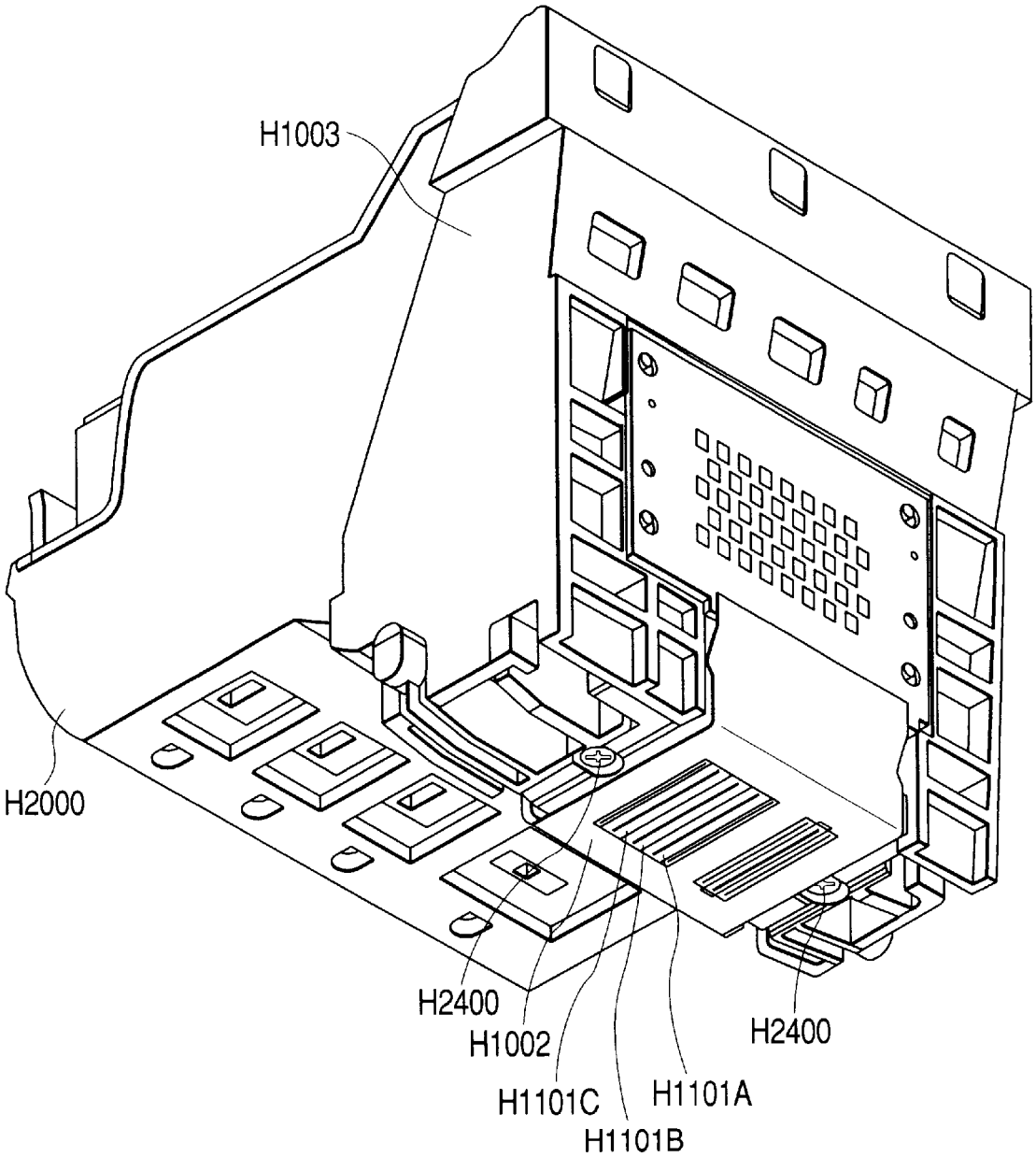
FIG. 19 is a perspective view of the recording head cartridge in an example 5 of the present invention.
Figure 20:
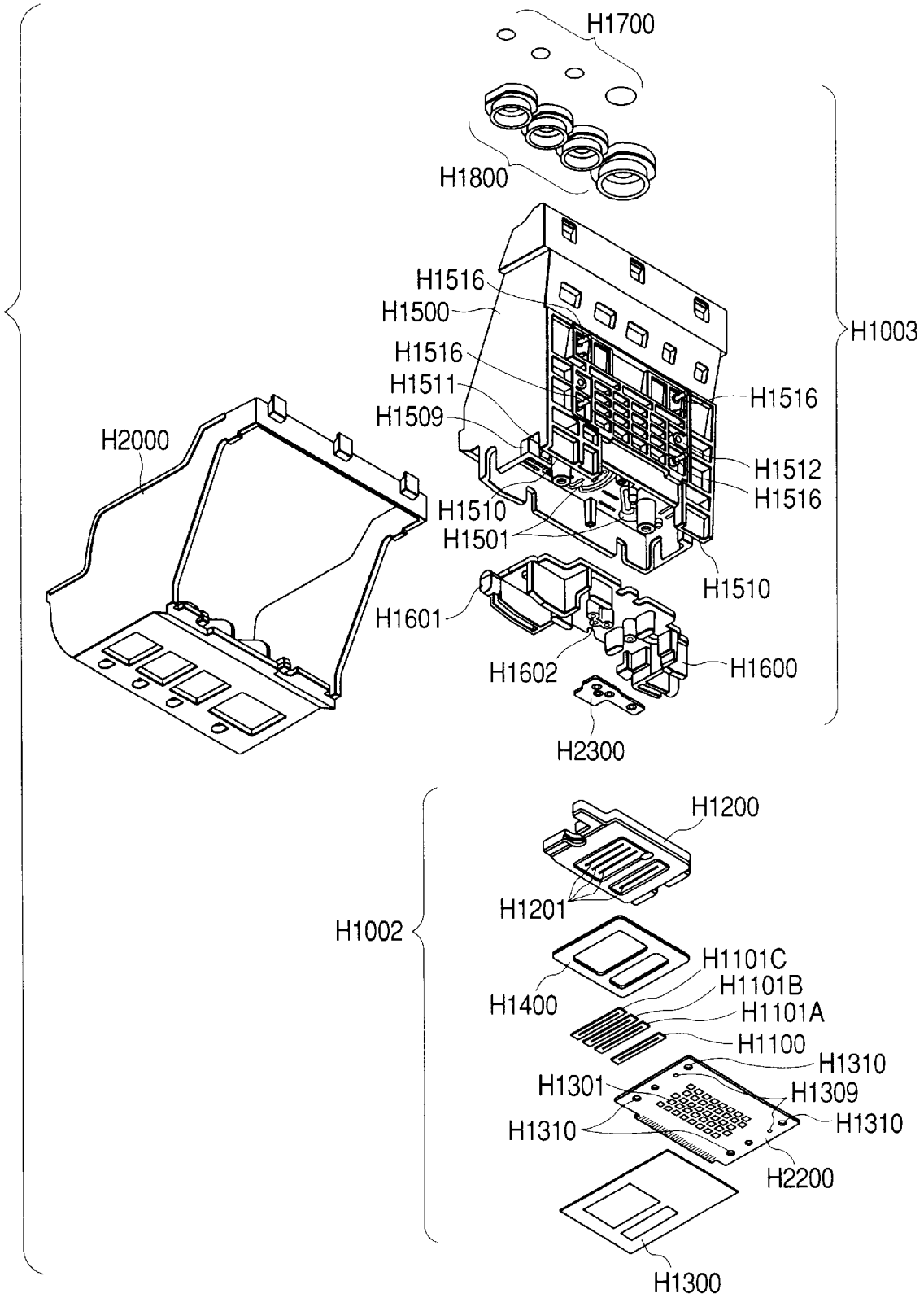
FIG. 20 is an exploded perspective view showing the configuration of the recording head shown in FIG. 19.

An example shown in FIGS. 19 and 20 is provided with three independent recording element substrates, namely a second recording element substrate H1101A (cyan), a third recording element substrate H1101B (magenta), and a fourth recording element substrate H1101C (yellow), instead of the second recording element substrate H1101 in the foregoing example 1 in which the mechanisms for cyan, magenta and yellow colors are integrated on a single recording element substrate. These second to fourth recording element substrates H1101A to H1101C have an external dimension same as that of the first recording element substrate H1100 but have the discharge openings H1107 and the electrothermal converting elements H1103 smaller than those in the first recording element substrate H1100.

In such recording head, each of the second, third and fourth recording element substrates H1101A to H1101C for three colors requires an adhering precision with ±0.01 mm, but the necessary adhering precision can be secured by precisely positioning these recording element substrates on the first plate H1200 utilizing image recognition and adhering these substrates by the second adhesive layer h1203.

Then, as explained in the foregoing, the bumps H1105 on the electrodes H1104 of the recording element substrates and the electrode leads H1302 of the electrical wiring tape H1300 are jointed one by one by the thermal ultrasonic pressing method to provide an ink jet recording head of high electrical reliability. As explained in the foregoing, also in case of an ink jet recording head in which the recording element substrates of a substantially same external dimension are arranged, it is possible achieve high reliability and a long service life by employing a single flexible wiring substrate with apertures of different dimensions.

Also in the present example, the areas of the electrical connecting portions are sealed as in the example 1. If the electrode portions of the third recording element substrate H1101B, positioned at the center in the recording element substrates of three colors, are sealed on the TAB tape as in the conventional TAB mounting process, the sealant may flow also to the rear adhering surface in case the distance to the adjacent recording element substrates is short, but, in the present example, the sealing is executed after the recording element substrates are adhered to another member, whereby an inexpensive ink jet recording head can be provided with a high production yield.

EXAMPLE 6

Figure 21:
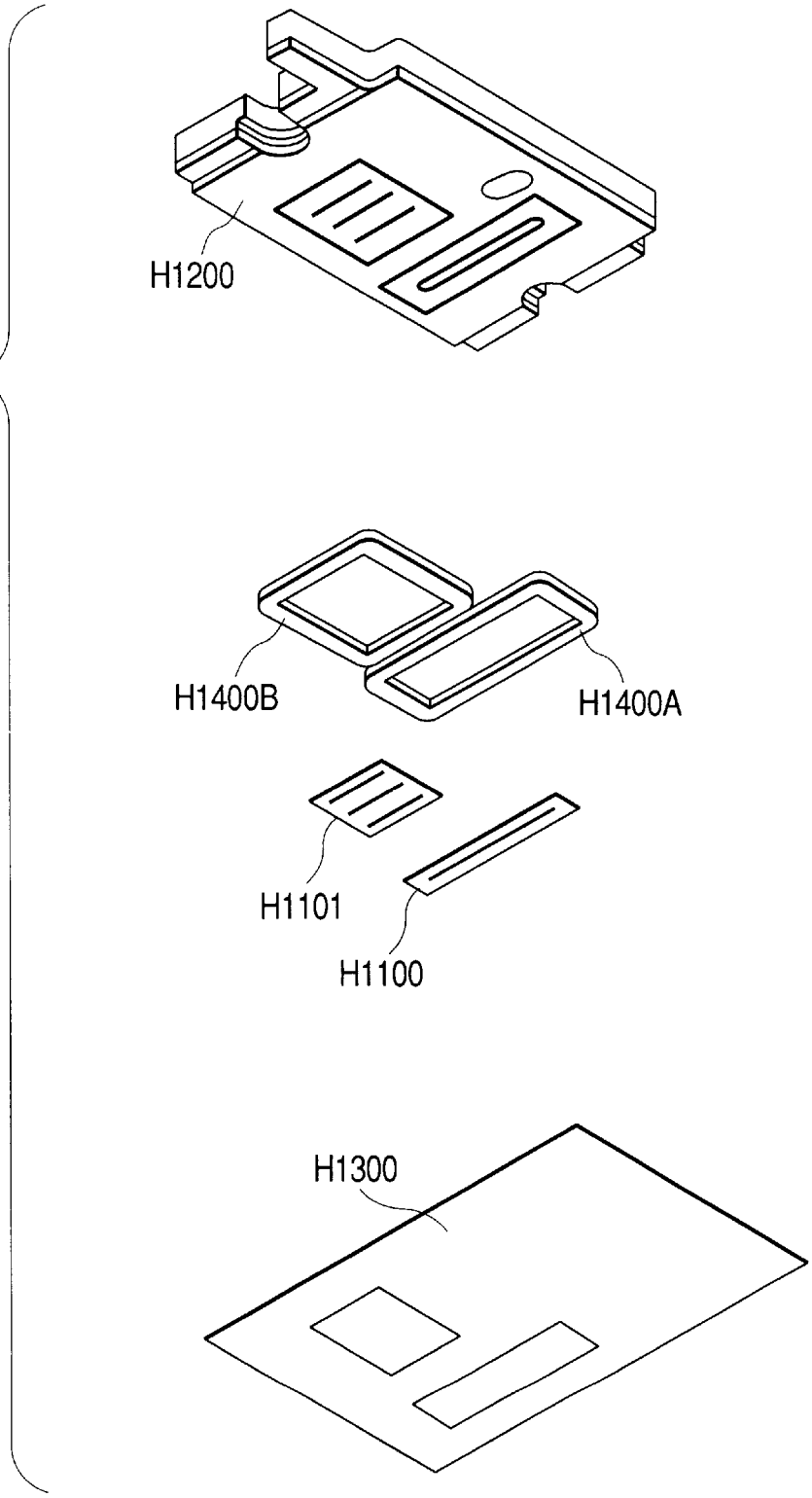
FIG. 21 is a schematic magnified and exploded perspective view of the recording element unit in an example 6 of the present invention.
Figure 22:
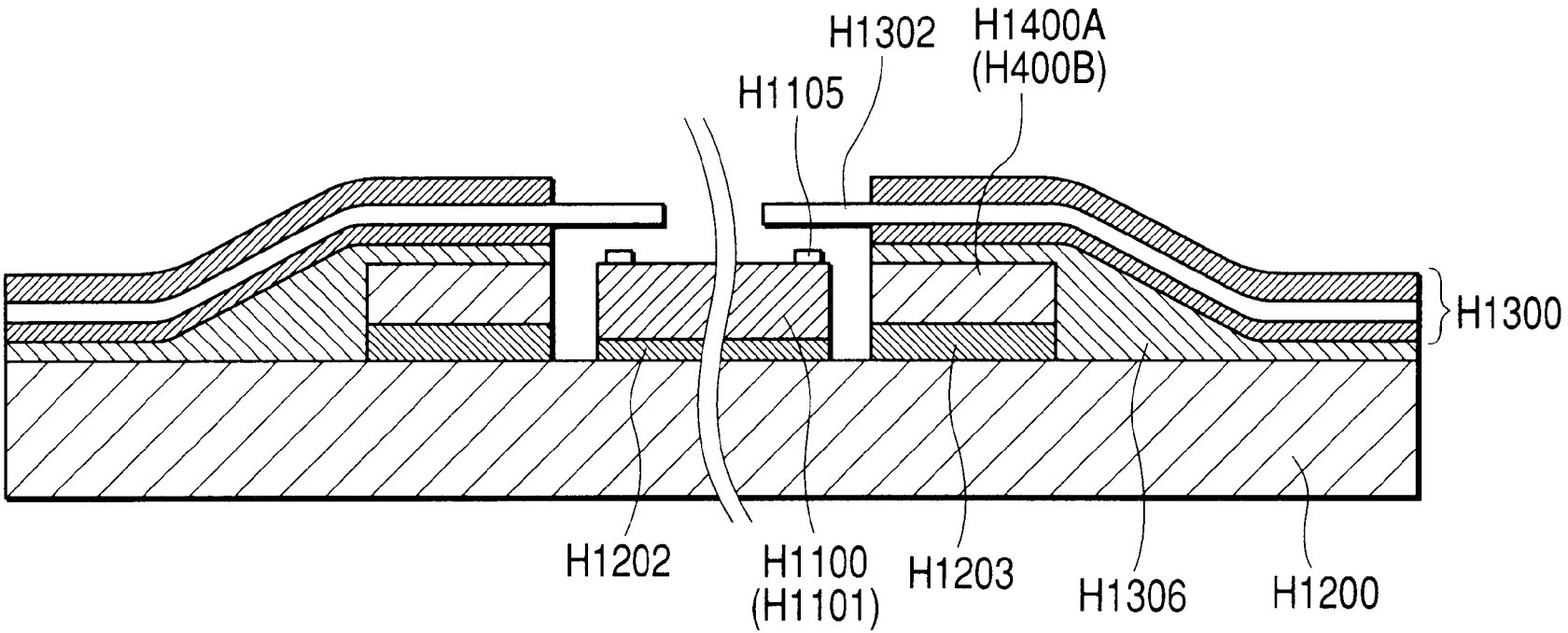
FIG. 22 is a schematic magnified cross-sectional view of the recording element unit in the example 6 of the present invention.

In an example shown in FIG. 21, the second plate is composed of independent frames H1400A, H1400B respectively surrounding two recording element substrates. The members and sealants used are same as in the example 1, except for the difference in the shape of the second plate. FIG. 22 is a cross-sectional view of the first plate H1200, the first recording element substrate H1100 (or second recording element substrate H1101), the second plate H1400A, H1400B and the electrical wiring tape (flexible printed circuit substrate) H1300 in a state where they are fixed in a laminar structure. In the present example, since the second plate is composed of frames surrounding the recording element substrates, the electrical wiring tape H1300 is positioned higher only in the vicinity of the bumps H1105 of the recording element substrate H1100 (H1101) and in the peripheral portion of the recording element substrate. Also in this example, it is possible to easily joint the bumps H1105 and the electrode leads H1302 by thermal ultrasonic pressing (inner lead bonding).

EXAMPLE 7

Figure 23:
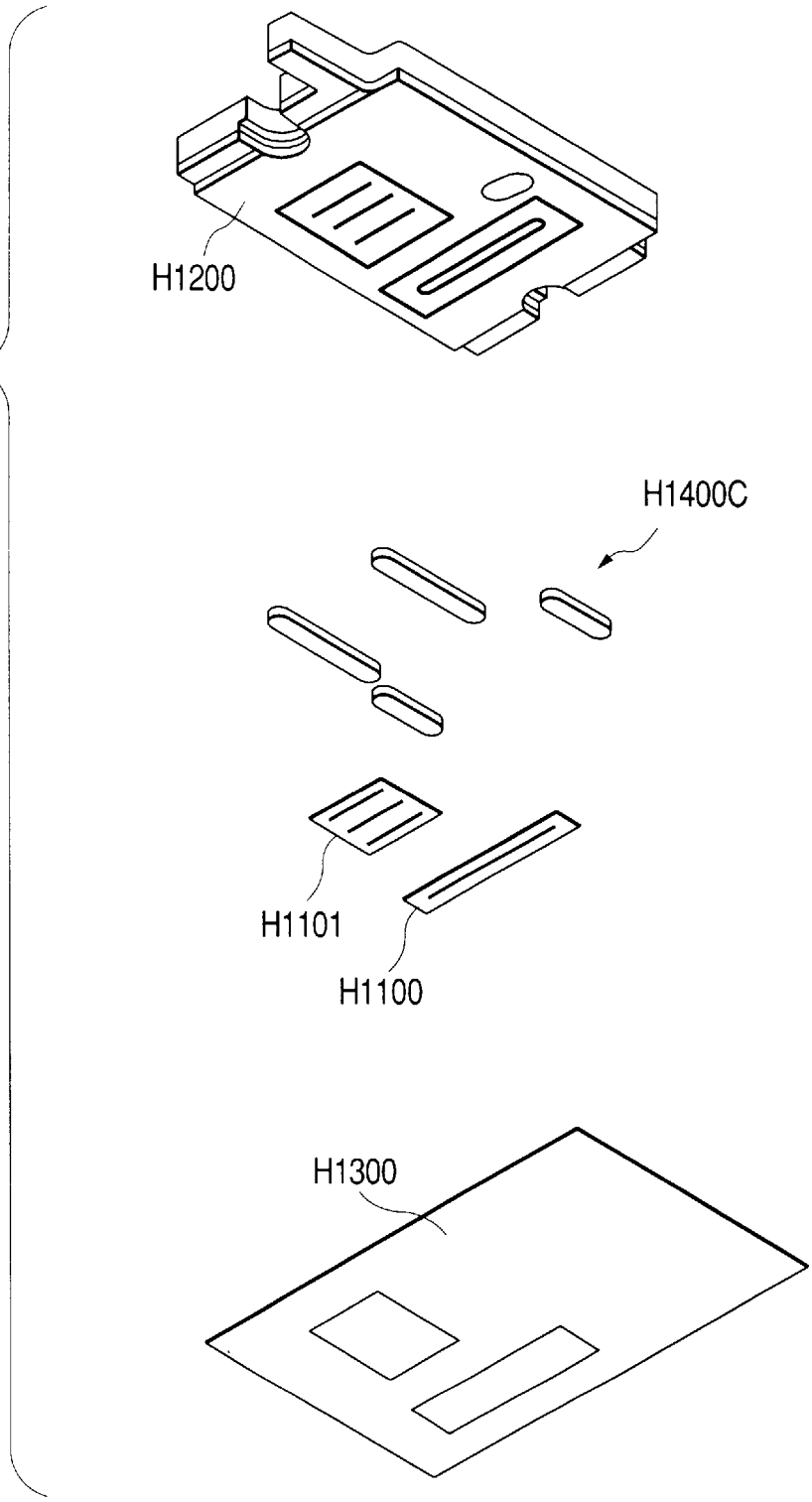
FIG. 23 is a schematic magnified and exploded perspective view of the recording element unit in an example 7 of the present invention.
Figure 24:
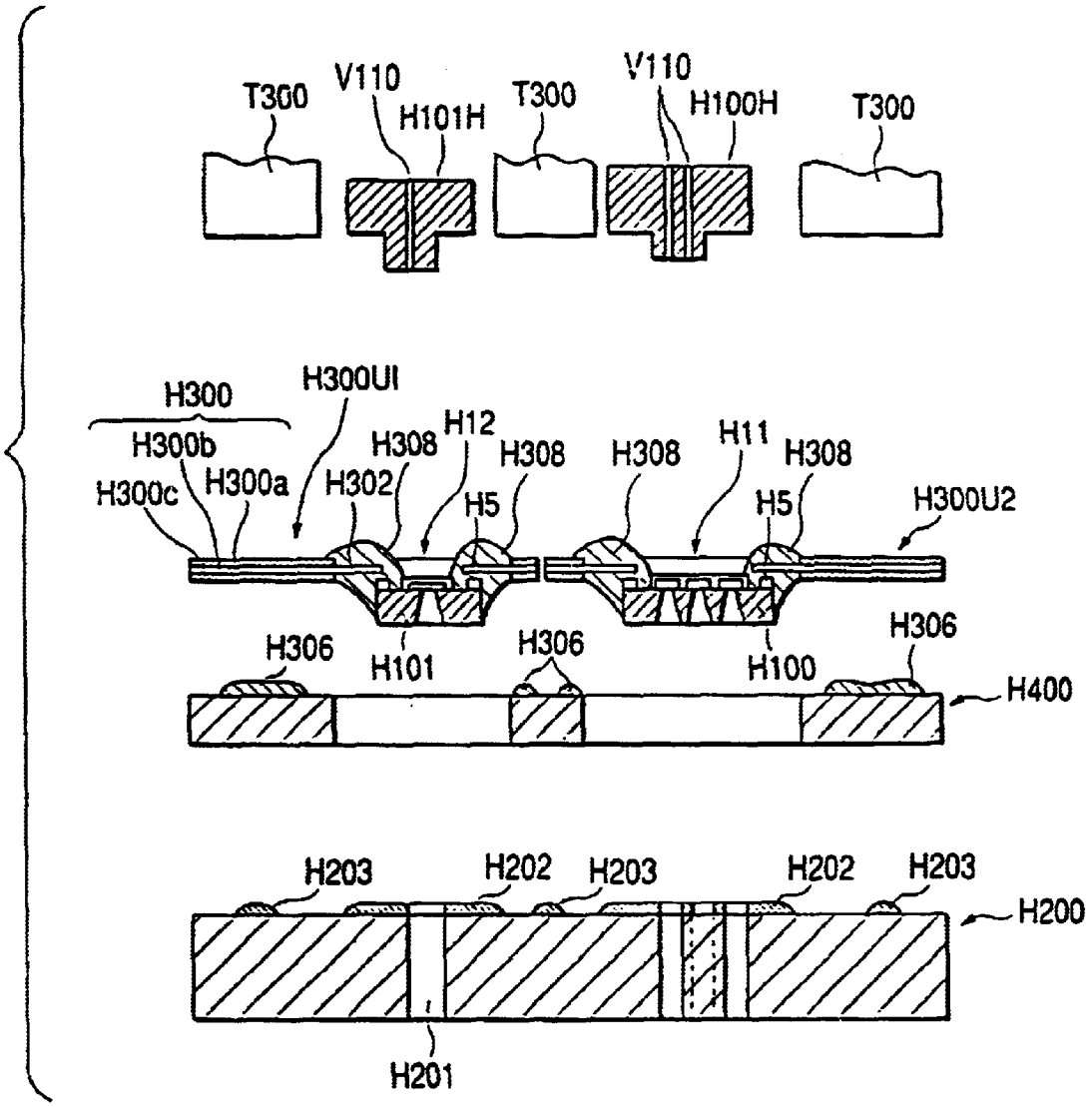
FIG. 24 is a schematic exploded cross-sectional view of a conventional recording element unit.

In an example shown in FIG. 23, a second plate H1400C is positioned only in the vicinity of the bumps H1105 of the two recording element substrates. The members and sealants used are same as in the example 1, except for the difference in the shape of the second plate. In the present example, since the second plate H1400C is positioned only in the vicinity of the bumps H1105 of the recording element substrate H1100 (H1101), the electrode leads H1302 of the electrical wiring tape H1300 are positioned higher only in the vicinity of the bumps H1105 of the recording element substrate H1100 (H1101).

Also in this example, it is possible to easily joint the bumps H1105 and the electrode leads H1302 by thermal ultrasonic pressing (inner lead bonding).

EXAMPLE 8

In the following there will be explained the details of the connecting portion between the electrodes H1104 of the first and second recording element substrates H1100, H1101 and the electrode terminals H1302 of the electrical wiring tape H1300, and the jointing thereof.

Figure 26:
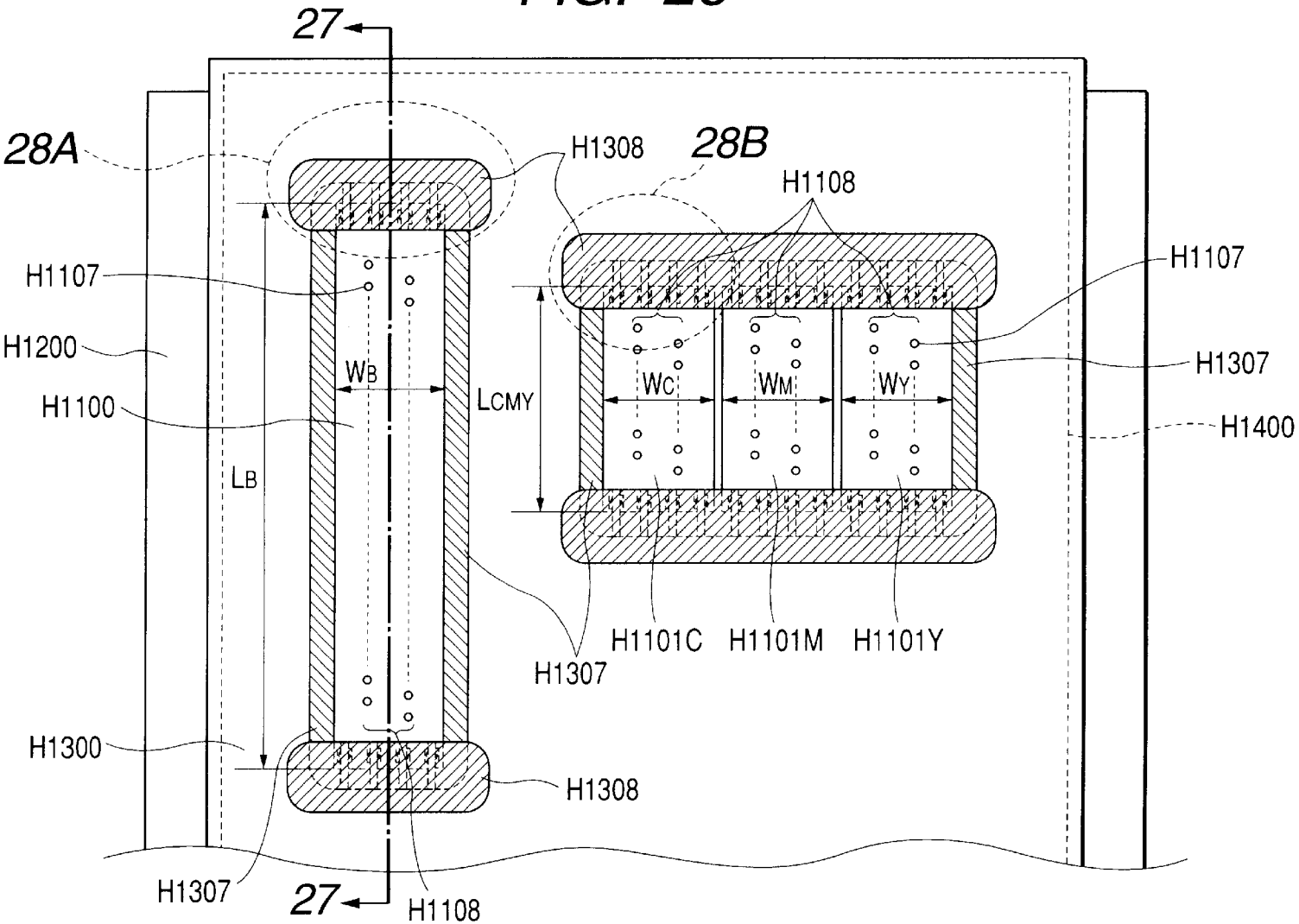
FIG. 26 is a partial plan view of the recording element unit seen from a direction A in FIG. 8.

FIG. 26 is a partial plan view of the recording element unit H1002 seen from a direction A shown in FIG. 8.

The first recording element substrate H1100 is for black ink recording. The second recording element substrate H1101 is for color inks, and is divided for respective colors into a cyan second recording element substrate H1101C, a magenta second recording element substrate H1101M and a yellow second recording element substrate H1101Y. In the present example, the array H1108 of the discharge openings of the recording element substrate for block color is made longer than those of the recording element substrates for color inks, so that, in a direction perpendicular to the arrays of the discharge openings, the recording element substrates have a same external dimension (or nearly same dimensions), but, in a direction along the array, the recording element substrate for black color is longer than those for other colors. More specifically, the widths WB, WC, WM and WY of the first recording element substrate H1100, the cyan second recording element substrate H1101C, the magenta second recording element substrate H1101M and the yellow second recording element substrate H1101Y are mutually same or substantially same, but the length LB of the first recording element substrate H1100 is larger than that LCMY of the second recording element substrate H1100. Such configuration is adopted for example in case of increasing the black recording speed by extending the array of the black discharging openings of higher recording frequency.

Also the arrangement pitch of the discharge opening array (recording element array) in the first recording element substrate is larger than that in the second recording element substrate. In the present example, in the first recording element substrate having a larger arrangement pitch of the discharge opening array, the arrangement pitch of the electrodes is selected smaller than in the second recording element substrate, thereby compactizing the recording head without influencing the functional elements for driving the recording elements. In the second recording element substrate, since the arrangement pitch of the recording elements is smaller, the area of the functional elements for driving the recording elements has to be reduced in order to reduce the size of the substrate. On the other hand, in the first recording element substrate, the functional elements can be placed without reducing the area thereof since the area still have certain margin in the direction along the array of the recording elements, whereby the dimension of the head can be reduced in the scanning direction thereof. Also in the present example, the discharge amount in the recording elements of the first recording element substrate is made larger than that in the second recording element substrate. Such configuration allows to attain satisfactory print speed and print quality both in the color recording and in the monochromatic recording.

Figure 27:
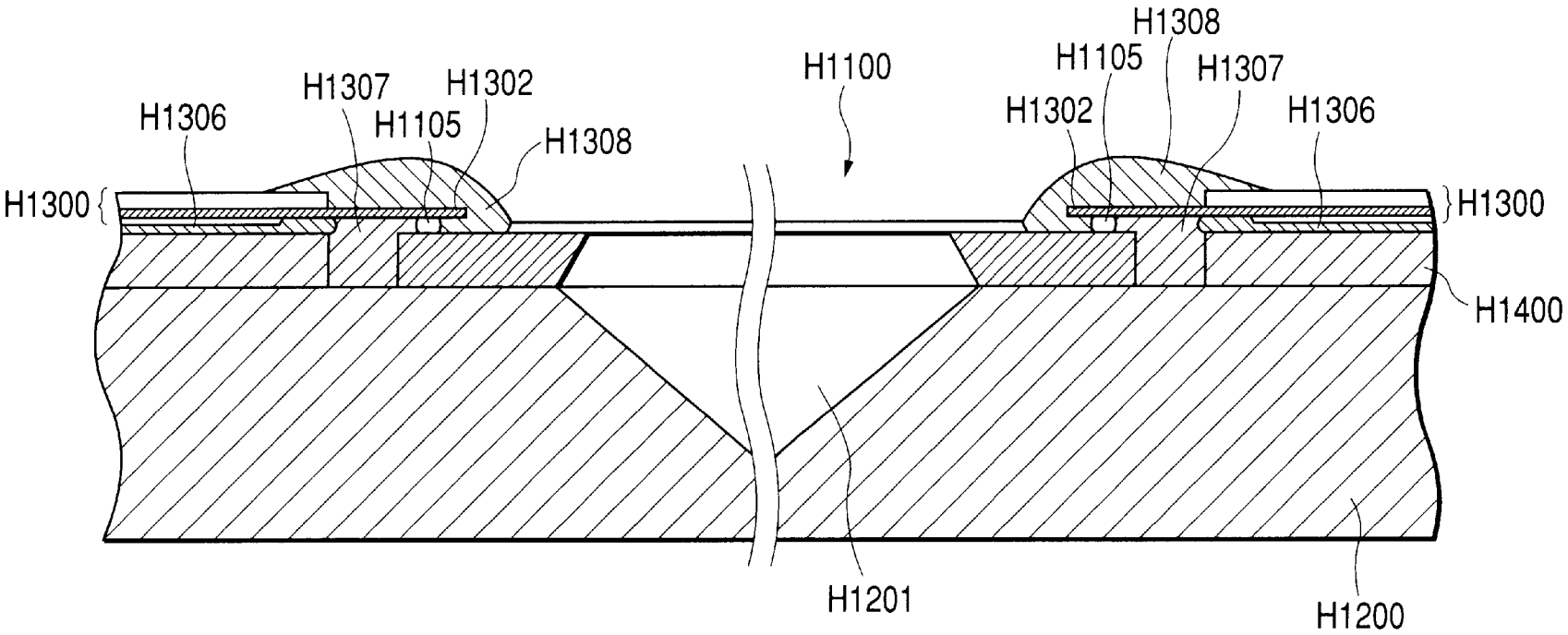
FIG. 27 is a partial cross-sectional view of the recording element unit along a line C—C in FIG. 26.

Now the cross-sectional configuration of the recording element substrate and the vicinity thereof will be explained with reference to FIG. 27 which is a partial cross-sectional view along a line 27—27 in FIG. 26. The cross section along the line 27—27 shows the cross-sectional configuration of the first recording element substrate H1100 and the vicinity thereof, but that of the second recording element substrate and the vicinity thereof is also similar.

To the first plate H1200, the first recording element substrate H1100 is precisely fixed by the unrepresented first adhesive. Also the second plate H1400 is fixed to the first plate H1200 by the unrepresented second adhesive. Onto the upper surface of the second plate H1400, the rear surface of the electrical wiring tape H1300 is adhered by the third adhesive H1306. The first recording element substrate H1100 is provided with the electrodes H1104 (not shown), on which formed are the bumps H1105 for example of Au. The electrode terminals H1302 provided in the aperture of the electrical wiring tape H1300 are electrically connected with the bumps H1105 for example by thermal ultrasonic pressing method to complete the electrical connection between the recording element substrates and the electrical wiring tape. The electrical connecting portions are sealed by the first sealant H1307 and the second sealant H1308 for protection from the erosion by ink or from the external impact.

Figure 28B:
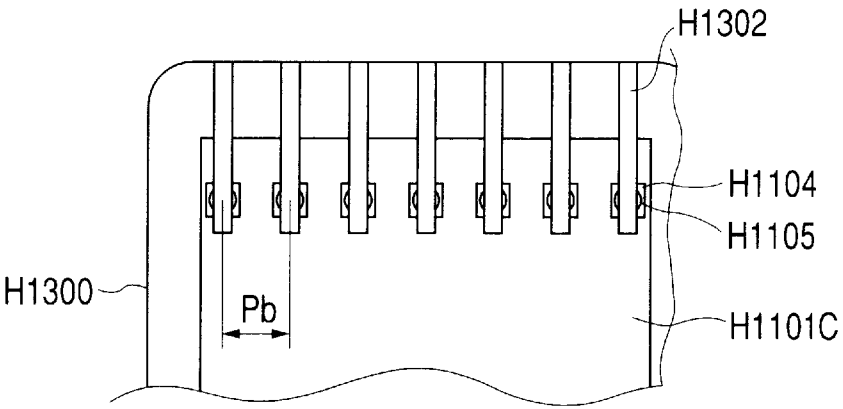
FIGS. 28A and 28B are views showing the arrangement pitch of the electrodes of the first and second recording element substrates and that of the electrode elements of an electrical wiring tape.
Figure 28A:
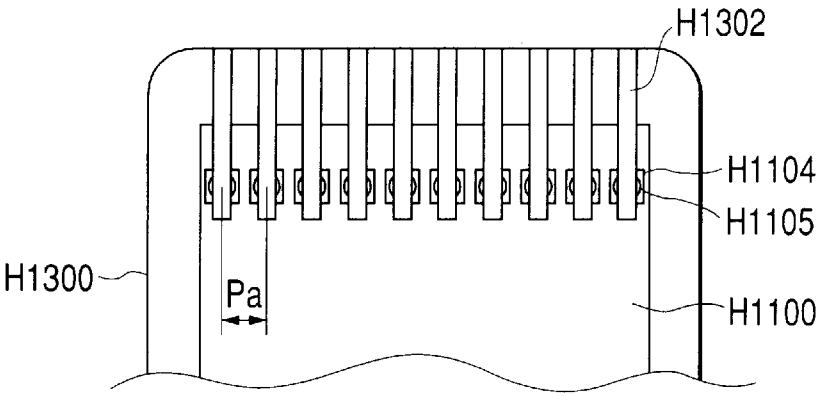

Now reference are made to FIGS. 28A and 28B for explaining further the configuration in the vicinity of the electrodes of each recording element substrate.

FIGS. 28A and 28B show an area A of the black electrodes of the first recording element substrate H1100 in FIG. 26, and an area B of the color electrodes of the cyan second recording element substrate H1101C. In the drawings showing the configuration of the electrodes including FIGS. 28A and 28B, the sealant is omitted for the purpose of clarity. Also the configuration of the electrode portions in the magenta second recording element substrate H1101M or in the yellow second recording element substrate H1101Y is similar to that of the cyan second recording element substrate H1101C and will not, therefore, be explained further.

In the present example, as explained in the foregoing, the discharge opening array H1108 of the black recording element substrate H1100 is made longer, and the number of the discharge openings H1107 is proportionally made larger than in the recording element substrates for the different colors. Consequently the number of signals to be exchanged with the main body of the recording apparatus is larger in the black, so that the number of the electrodes H1104 is larger in the first recording element substrate H1100 than in the cyan second recording element substrate H1101C.

In the manufacture of the ink jet recording head, the bumps formed on the electrodes of each recording element substrate are electrically jointed with the electrode terminals of the electrical wiring tape as explained in the foregoing, for example by the thermal ultrasonic pressing, and in such operation, the probability of defects resulting from the electrical shortcircuiting may increase if the arrangement pitch of the electrodes is made smaller. However, if the arrangement pitch of the electrodes is increased, the dimension of the recording element substrate is increased, leading to an increased cost and a larger dimension of the main body of the recording apparatus.

Therefore, in the recording head H1001 of the present example, the arrangement pitch Pb of the electrodes H1104, fewer in the number, in the cyan second recording element substrate H1101C, magenta second recording element substrate H1101M and yellow second recording element substrate H1101Y is selected larger than the arrangement pitch Pa of the electrodes H1104, larger in the number, of the black first recording element substrate H1100, in order to reduce such defects resulting in the thermal ultrasonic pressing operation.

In the present example, as an example of the electrode arrangement pitch, the arrangement pitch Pa for black color is selected as 0.15 to 0.17 mm, while that Pb for other colors is selected as 0.2 to 0.25 mm.

In the foregoing example, it is assumed that the shortcircuiting defect rate for the electrode arrangement pitch Pa for the black color is 4 per 100 recording element substrates. If the arrangement pitch Pb for other colors is selected same, the defect rate becomes same as that for the black color namely 4/1000 for each color and 16/1000 at maximum in simple calculation in each recording element unit integrating four colors. Even in consideration of a fact that the number of the electrodes for other colors is smaller than that for black color, namely if the number of electrodes for another color is 7/10 of that for black color, the defect rate becomes 2.8/1000 for color or 12.4/1000 at maximum in the recording element unit. (In the foregoing calculation, it is assumed that two or more defects do not occur in the single recording element unit.) On the other hand, if the defect rate is reduced to 0.5 per 1000 recording element substrates by expanding the electrode arrangement pitch for other colors for which the number of electrodes is reduced, the defect rate is lowered to 5.5/1000 in the unit of the recording element unit, representing a significant reduction in the defects in the ultrasonic pressing process.

In the following there will be explained the alignment among the first recording element substrate H1100 of the arrangement pitch Pa, the second recording element substrate H1101 of the arrangement pitch Pb and the electrode terminals H1302 of the electrical wiring tape H1300.

Figure 29A:
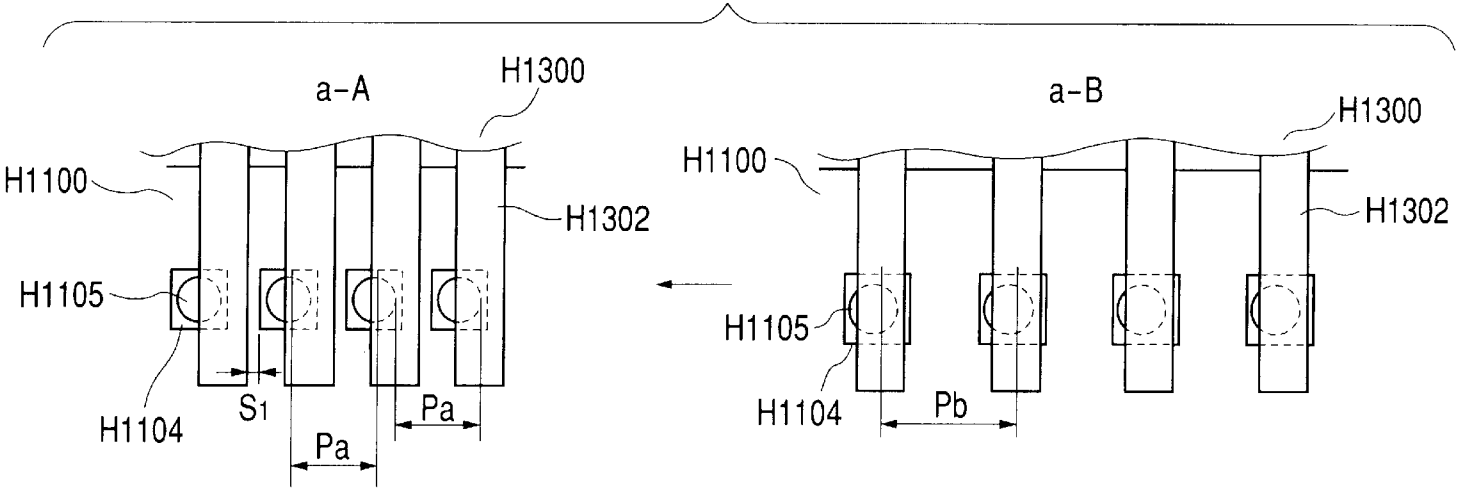
FIGS. 29A and 29B are views showing the alignment of the electrodes of the first and second recording element substrates and that of the electrode elements of the electrical wiring tape.
Figure 29B:
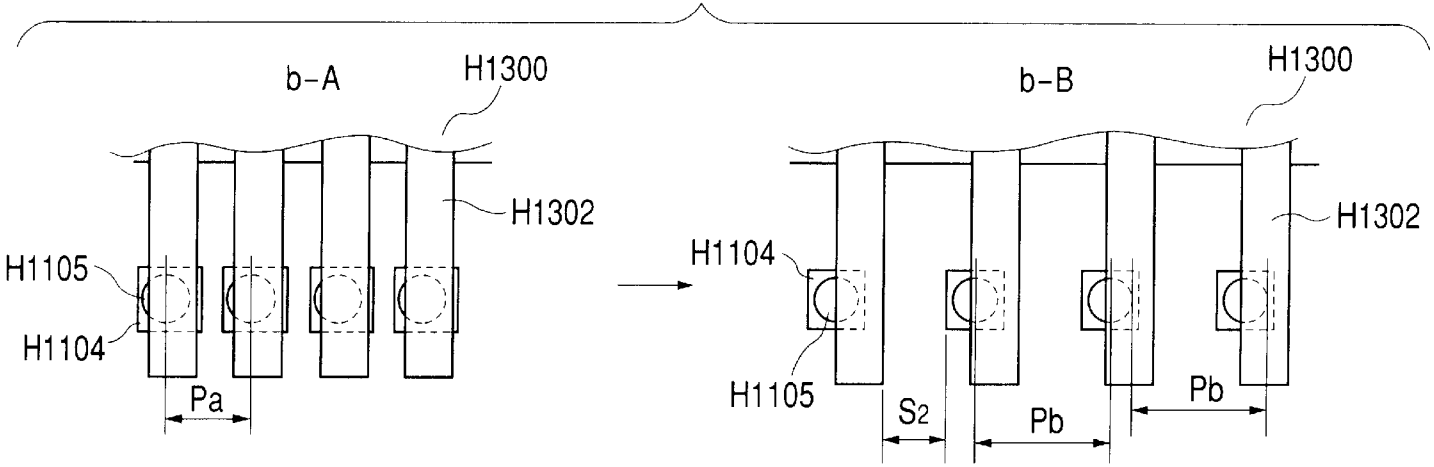

In FIGS. 29A shows a reference example of the alignment in the present example, wherein a-A is a magnified view of a portion A in FIG. 26 while a-B is a magnified view of a portion B therein, showing a state where the electrical wiring tape H1300 is aligned and fixed by adhesion to the second plate H1400. In FIGS. 29A and 29B, the thermal ultrasonic pressing of the bumps H1105 and the electrode terminals H1104 and the sealing of the electrical connecting portions are not yet executed.

In the present reference example, in jointing the electrodes H1104 of each recording element substrate and the electrode terminals H1302 of the electrical wiring tape H1300, the alignment is executed between the bumps H1105 on the electrodes H1104 of the second recording element substrate H1101 of the wider electrode arrangement pitch and the corresponding electrode terminals H1302 of the electrical wiring tape H1300, namely at the side a-B in FIG. 29A.

In such situation, as shown in a-B in FIG. 29A, the electrodes H1104 (bumps H1105) and the electrode terminals H1302 are almost satisfactorily aligned on the second recording element substrate H1101, but the electrodes H1104 (bumps H1105) and the corresponding electrode terminals H1302 of the electrical wiring tape are mutually displaced on the first recording element substrate H1100 as shown in a-A. Such displacement results in combination from (1) fluctuation in the assembling of the plural recording element substrates to the first plate H1200 (particularly mutual displacement among the plural recording element substrates), (2) fluctuation in the assembling of the electrode terminals H1302 of the electrical wiring tape H1300 by aligning and fixing with the bumps H1105 on the electrodes H1104 of each recording element substrate, (3) fluctuation resulting from thermal elongation of the electrical wiring tape H1300 in case of using thermosetting adhesive for fixing the electrical wiring tape H1300 to the second plate H1400, and (4) fluctuation in the dimension of each component.

In case such displacement is generated between the bumps H1105 on the electrodes H1104 and the electrode terminals H1302 of the electrical wiring tape H1300, since the electrode arrangement pitch Pa is small in the first recording element substrate H1100, the distance S1 between an end of the electrode terminal and an electrode adjacent to the proper electrode for connection becomes very small. If the bump H1105 and the electrode terminal H1302 in such positional relationship are jointed for example by ultrasonic pressing, there results a danger that the electrode terminal H1302 comes into contact with the electrode adjacent to the proper electrode, thereby increasing the probability of electrical shortcircuiting. Such probability may become even higher depending on the condition of ultrasonic pressing, causing a bending in the electrode terminals H1302 of the electrical wiring tape H1300 or crushing of the bumps H1105.

In the present example, therefore, the alignment is executed between the bumps H1105 on the electrodes H1104 and the corresponding electrode terminals H1302 of the electrical wiring tape H1300, namely at the side of the first recording element substrate H1101 of the narrower electrode arrangement pitch as shown in FIG. 29B.

In the present example, the displacement between the electrodes H1104 (bumps H1105) and the electrode terminals H1302 is generated in the second recording element substrate H1101 by the fluctuation in assembling as in the reference example shown in FIG. 29A, but, since the electrode arrangement pitch Pb of the second recording element substrate H1101 is larger than that Pa of the first recording element substrate H1100, the distance S2 between the end of the electrode terminal and the end of an electrode adjacent to the properly corresponding electrode is sufficiently large, thus significantly reducing the probability of shortcircuiting.

As an example of the dimensions, the electrode H1104 has a dimension of 0.12×0.12 mm, while the electrode terminal H1302 has a width of 0.085 mm, the arrangement pitch Pa of the electrodes H1104 of the first recording element substrate H1100 is selected as 0.165 mm while the arrangement pitch Pb of the electrodes H1104 of the second recording element substrate H1101 is selected as 0.24 mm and the total displacement between the electrode terminal H1302 and the electrode H1104 resulting from the aforementioned fluctuations in assembling is assumed as 0.04 mm, whereby the distance between the end of the electrode terminal and the end of the adjacent electrode becomes 0.0225 mm in case of the reference example shown in FIG. 29A while 0.0975 mm in case of the present example shown in FIG. 29B, thereby almost annulating the generation of shortcircuiting. It is therefore possible, in the electrical jointing step such as ultrasonic pressing, to significantly improve the production yield.

Figure 30:
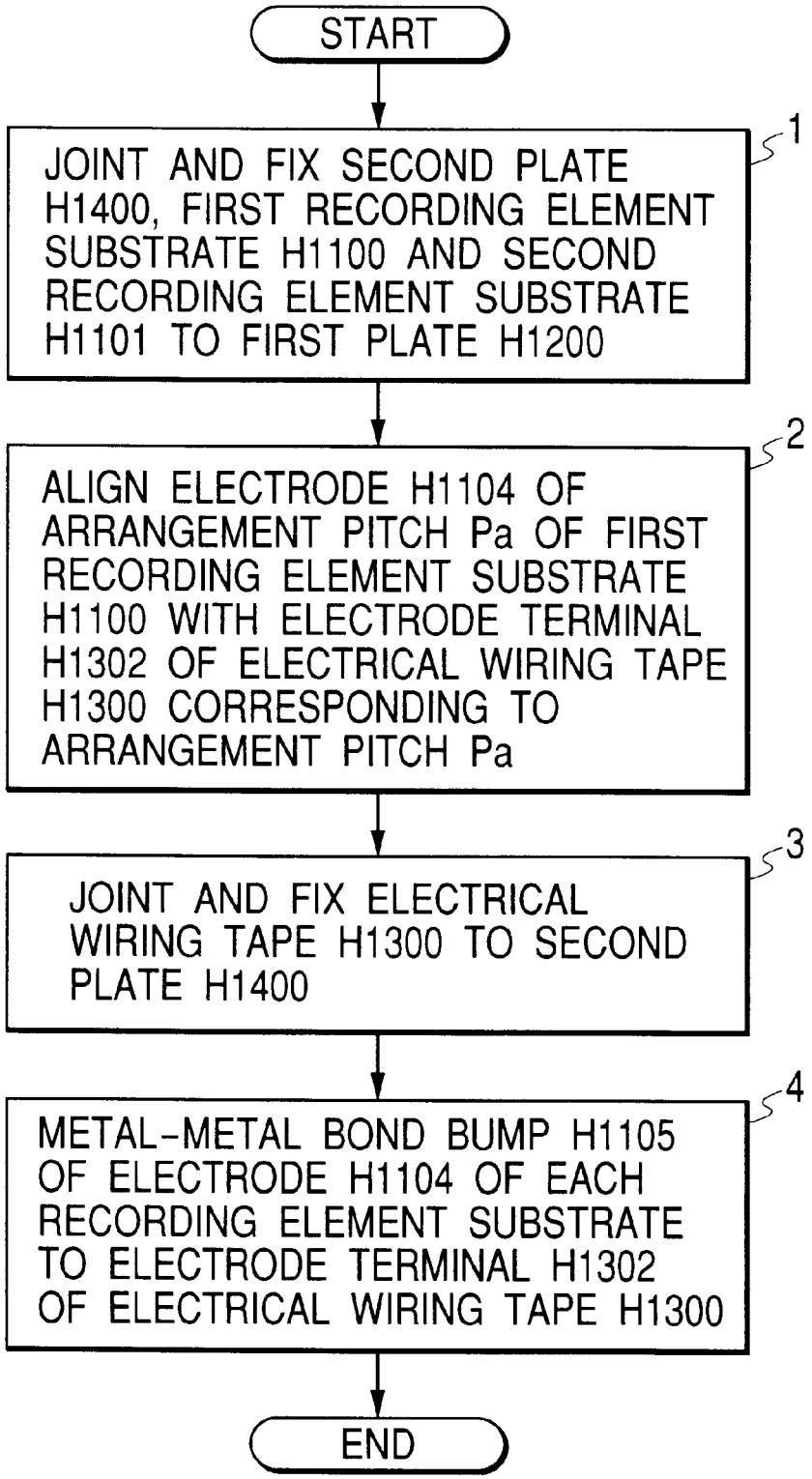
FIG. 30 is a flow chart showing outline of the alignment and jointing between the electrodes of the recording element substrates and the electrode terminals of the electrical wiring tape in a method for producing the ink jet recording head constituting an example 8 of the present invention.

The above-described alignment and jointing between the electrodes of the recording element substrate and the electrode terminals of the electrical wiring tape, in the method for producing the ink jet recording head of the present example, are summarized in a flow chart shown in FIG. 30.

At first, to the first plate H1200, there are adhered and fixed the second plate H1400, the first recording element substrate H1100 and the second recording element substrate H1101 (step 1).

Then the electrodes H1104 of the arrangement pitch Pa of the first recording element substrate H1100 are aligned with the electrode terminals H1302, corresponding to such arrangement pitch Pa, of the electrical wiring tape H1300 (step 2).

Then the electrical wiring tape H1300 is adhered and fixed to the second plate H1400 (step 3).

Finally, metal—metal bonding is executed between the bumps H1105 of the electrodes H1104 of each recording element substrate and the electrode terminals H1302 of the electrical wiring tape H1300 (step 4).

In this manner, the electrodes and the electrode terminals can be connected with high positional precision.

In the producing method of the present example for the ink jet recording head, as explained in the foregoing, the alignment is executed on the narrower arrangement pitch Pa of the electrodes H1104 instead of the wider arrangement pitch Pb thereof, thereby reducing the defective electrical connection between the electrodes H1104 of each recording element substrate and the electrode terminals H1302 of the electrical wiring tape H1300 which is to be electrically connected with such recording element substrate.

EXAMPLE 9

Figure 31:
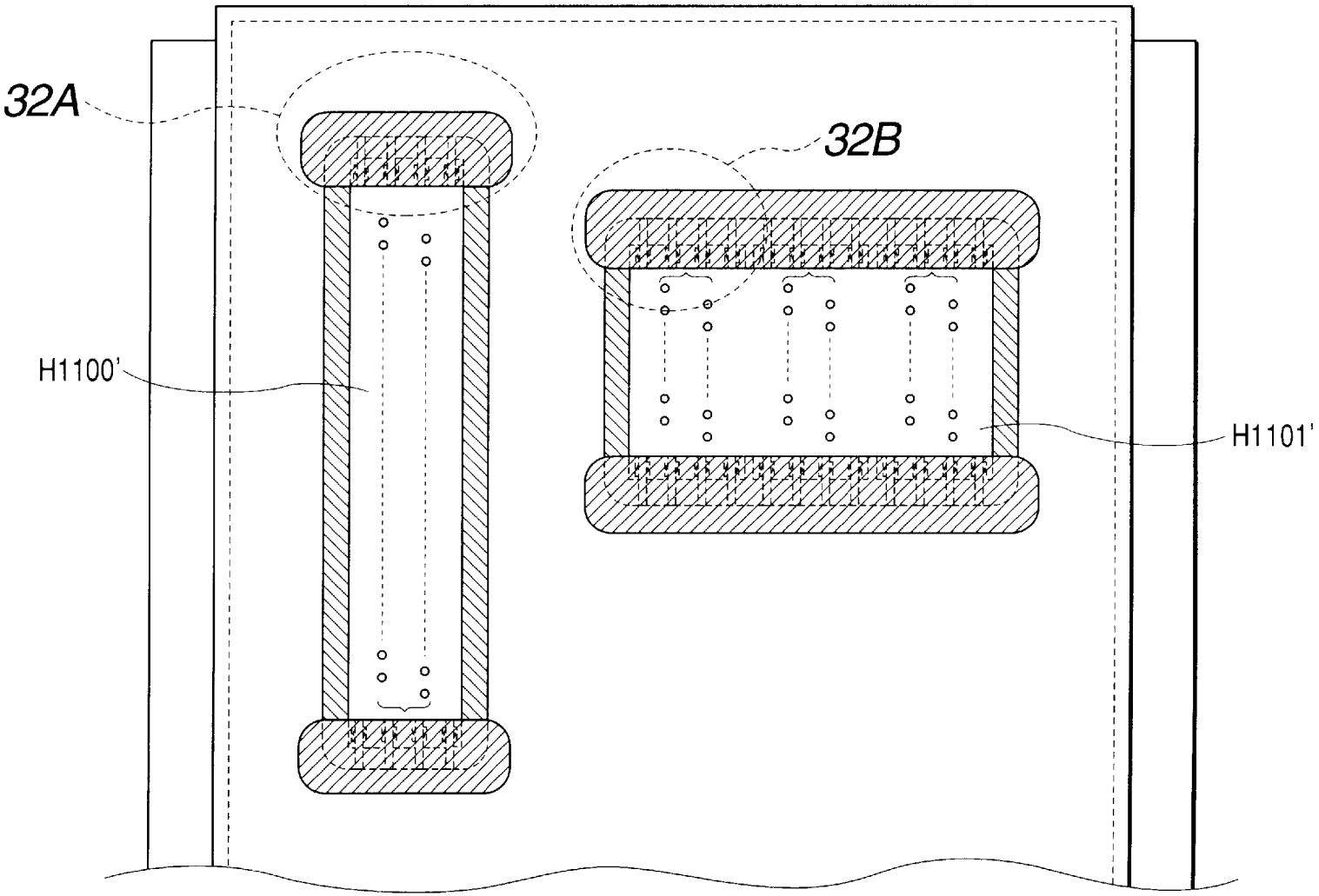
FIG. 31 is a partial plan view of the recording element unit in the ink jet recording head of an example 9 of the present invention.

FIG. 31 is a partial plan view of the recording element substrate of the present example.

Figure 32A:
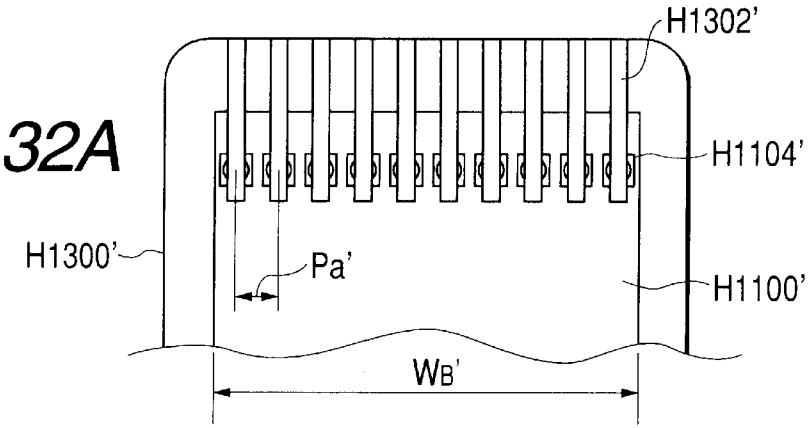
FIGS. 32A and 32B are partial magnified views of the electrodes of the recording element substrate and the electrode terminals of the electrical wiring tape in the recording element unit shown in FIG. 31.
Figure 32B:
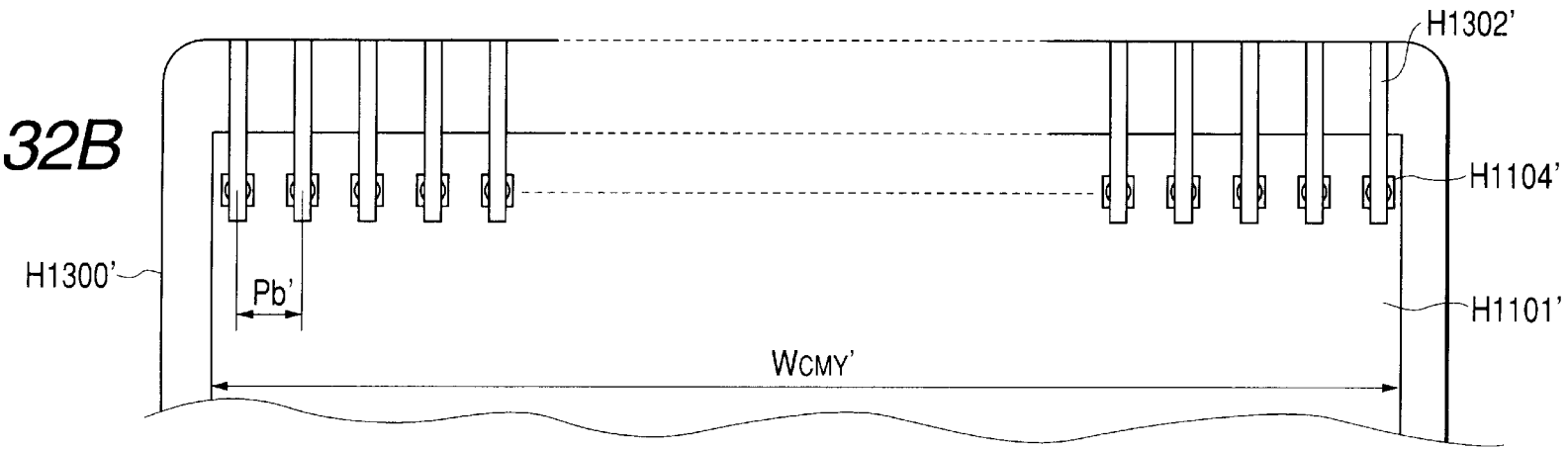

In contrast to the foregoing example 8 in which the second recording element substrate is divided into respective colors, the second recording element substrate H1101' of the present example is collectively integrated for cyan, magenta and yellow colors. Consequently, as shown in FIGS. 32A and 32B, the width WCMY of the second recording element substrate H1101' is larger than that WB' of the first recording element substrate H1100' for black color, but other configurations are same as in the foregoing example 8 and will not, therefore, be explained further.

Also in the configuration of the present example, the electrode arrangement pitch Pb' in the second recording element substrate H1101' for other colors is larger than the electrode arrangement pitch Pa' of the first recording element substrate H1100' for black color, but, since three colors are integrated in the second recording element substrate H1101', some of the signals to be exchanged with the recording apparatus can be made common for the three colors, so that the number of the electrodes per color can be reduced by such common portion and the electrode pitch Pb can therefore be made even larger.

In the producing method of the present example for the ink jet recording head, as explained in the foregoing, the alignment is executed on the narrower arrangement pitch Pa' of the electrodes H1104' instead of the wider arrangement pitch Pb' thereof, thereby reducing the defective electrical connection between the electrodes H1104' of each recording element substrate and the electrode terminals H1302' of the electrical wiring tape H1300' which is to be electrically connected with such recording element substrate.

Also in the present example, the second recording element substrate H1101' integral for three colors allows to reduce the number of electrodes, thereby further increasing the electrode pitch Pb and reducing the defects in the electrical connection.

EXAMPLE 10

Figure 33:
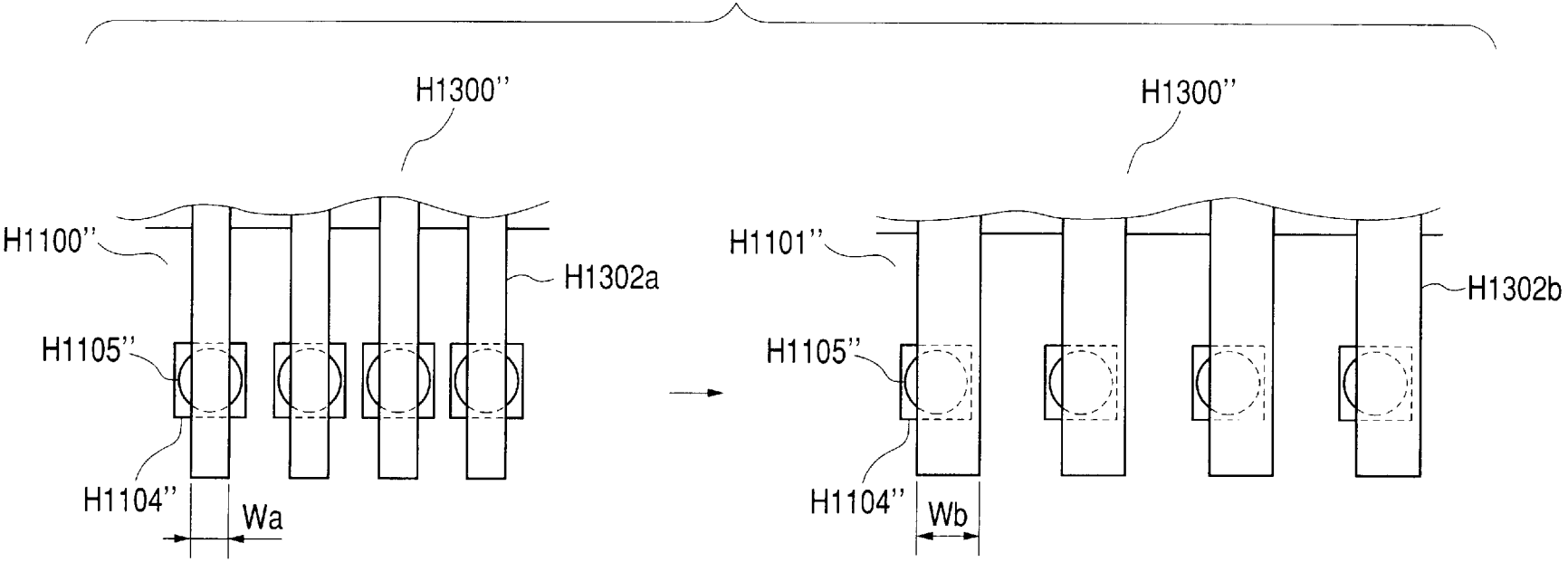
FIG. 33 is a view showing the difference in the width of the electrode terminals of the electrical wiring tape in the ink jet recording head in an example 10 of the present invention.

FIG. 33 is a partial plan view of the recording element substrate of the present example.

In the present example, the configuration is same as in the foregoing example 8 except that the width Wb of the electrode terminals H1302*b* to be connected to the electrodes H1104" (bumps H1105") of the second recording element substrate H1101" is larger than the width Wa of the electrode terminals H1302*a* to be connected to the electrodes H1104" (bumps H1105") of the first recording element substrate H1101", and will not therefore be explained further. Also the present example may naturally be used in combination with the foregoing example 9.

In the present example, even if a displacement is generated between the bumps H1105" on the electrodes H1104" and the electrode terminals after the alignment of the electrical wiring tape H1300" and fixation thereof to the second plate H1400, the electrode terminals H1302*b* engage larger with the bumps H1005" of the second recording element substrate H1101", whereby an electrically open or non-contact state can be reduced between the electrodes H1104" and the electrode terminals H1302*b* in the electrical jointing process for example by thermal ultrasonic pressing method.

As the first recording element substrate H1100" has a smaller electrode arrangement pitch, an increase in the width Wa of the electrode terminals H1302*a* is not adequate because it may increase the probability of shortcircuiting, but the configuration of the present example is possible because the second recording element substrate H1101" has a larger electrode arrangement pitch. However, the width of the electrode terminals has to be maintained within an appropriate range, since an excessive width increases the repulsive force of the electrode terminals H1302*b*, thereby hindering sufficient pressing.

As an example, the widths Wa, Wb are respectively selected as 50 to 85 $\mu$m and 75 to 100 $\mu$m.

In the producing method of the present example for the ink jet recording head, as explained in the foregoing, the alignment is executed with the electrodes and the electrode terminals of the smaller arrangement pitch as in the foregoing two examples (examples 8 and 9) to achieve connection with reduced defect.

Also in the present example, since the width Wb of the electrode terminals H1302*b* of the larger arrangement pitch is larger than the width Wa of the electrode terminals H1302*a* of the smaller arrangement pitch, the electrode terminals H1302*b* have a larger engagement with the bumps H1105" of the second recording element substrate H1101" thereby reducing the electrically open state.

In the foregoing examples, there have been explained configurations employing a single electrical wiring tape provided with plural apertures for the plural recording element substrates, but the aforementioned effects are not limited to such configurations and can be fully exploited for example also in a configuration employing a single electrical wiring tape with a single aperture.

Also in the foregoing examples, the recording element unit employs two plate, namely the first and second plate, but such two plates may be united as a single plate.

Furthermore, the dimensional figures in the foregoing examples are merely given as examples and are not to limit the present invention to such figures. These figures may be suitably determined in consideration of the fluctuation in assembling the components, precision of each component, dimension thereof, required precision etc. What matters is the basic concept of the present invention.

Furthermore, the present invention naturally includes embodiments in which all or a part of the aforementioned embodiments and examples are adopted in combination.

What is claimed is:

1. A method for producing an ink jet recording head including:

a plurality of recording element substrates each including a recording element for generating energy to be used for ink discharge and an electrode portion connected to said recording element;

a wiring substrate provided with electrode terminals to be electrically connected with said electrode portions of said plural recording element substrates, respectively, and adapted to transmit an electrical pulse for ink discharge to said recording elements, respectively; and an element substrate support member for supporting said plural recording element substrates, the method comprising:

a step of causing said plural recording element substrates to be supported on said element substrate support member; and a step of thereafter executing metal–metal bonding between said electrode portions of said plural recording element substrates and said electrode terminals of said wiring substrate, respectively.

2. A method according to claim 1, wherein said metal—metal bonding is executed by thermal ultrasonic pressing.

3. A method according to claim 1, wherein said metal—metal bonding is executed by wire bonding.

4. A method according to claim 1, wherein said plural recording element substrates include first and second recording element substrates, and the method further comprises a step, in connecting said electrode terminals of said wiring substrate to first electrode portions arranged with a first arrangement pitch in said first recording element substrate and to second electrode portions arranged with a second arrangement pitch, larger than said first arrangement pitch, in said second recording element substrate, of executing alignment with reference to said first arrangement pitch.

5. A method for producing an ink jet recording head including:

a plurality of recording element substrates each including a recording element for generating energy to be used for ink discharge and an electrode portion connected to said recording element;

a wiring substrate provided with electrode terminals to be electrically connected with said electrode portions of said plural recording element substrates, respectively, and adapted to transmit an electrical pulse for ink discharge to said recording elements, respectively;

an element substrate support member for supporting said plural recording element substrates; and a wiring substrate support member for supporting said wiring substrate and to be fixed on said element substrate support member, the method comprising, in this order:

a step of fixing said plural recording element substrates and said wiring substrate support member on said element substrate support member;

a step of fixing said wiring substrate on said wiring substrate support member with said electrode terminals of said wiring substrate being aligned with respect to said electrode portions of said plural recording element substrates, respectively; and a step of executing metal—metal bonding between said electrode portions of said plural recording element substrates and said electrode terminals of said wiring substrate, respectively.

6. A method according to claim 5, wherein the step of fixing said plural recording element substrates and said wiring substrate support member on said element substrate support member is executed with an adhesive and the method further comprises, after the step of executing metal—metal bonding between said electrode portions of said plural recording element substrates and said electrode terminals of said wiring substrate, a step of sealing the joined portions of said electrode portions and said electrode terminals.

7. A method according to claim 5, wherein each of said electrode portions of said plural recording element substrates includes a metal—metal bonded bump.

8. A method according to claim 5, wherein said wiring substrate is provided with plural apertures in which said plural recording element substrates are respectively assembled and the method further comprises a step of sealing the respective peripheries of said recording element substrates in said respective apertures with resin.

9. A method according to claim 5, wherein, in the step of fixing said plural recording element substrates on said wiring substrate support member, said electrode portions of said plural recording element substrates are so positioned as not to assume a same height on said wiring substrate support member.

10. A method according to claim 5, wherein said plural recording element substrates are mutually different in at least one of the size and the shape.

11. A method according to claim 10, wherein said wiring substrate is provided with plural apertures in which said plural recording element substrates are respectively assembled and said apertures are mutually different in at least one of the size and the shape.

12. A method according to claim 5, wherein, in the step of fixing said wiring substrate on said wiring substrate support member, positioning is so executed that the gap between said electrode portions of said plural recording element substrates and said electrode terminals of said wiring substrate, respectively, does not exceed 100 $\mu$m and metal—metal bonding is then executed therebetween.

13. A method according to claim 5, wherein the step of fixing said plural recording element substrates and said wiring substrate support member on said element substrate support member includes a step of fixing said plural recording element substrates by a first adhesive layer on said element substrate support member and a step of fixing said wiring substrate support member by a second adhesive layer on said element substrate support member; and the sum of the thickness of said plural recording element substrates and the thickness of said first adhesive layer is smaller than the sum of the thickness of said wiring substrate support member and the thickness of said second adhesive layer.

14. An ink jet recording head comprising:

a first recording element substrate including plural first recording elements arranged with a first element arrangement pitch and adapted to generate energy to be used for ink discharge and plural first electrode portions arranged with a first electrode arrangement pitch and connected respectively to said plural first recording elements;

a second recording element substrate including plural second recording elements arranged with a second element arrangement pitch and adapted to generate energy to be used for ink discharge and plural second electrode portions arranged with a second electrode arrangement pitch and connected respectively to said plural second recording elements; and a wiring substrate including plural first electrode terminals electrically connected to said plural first electrode portions and plural second electrode terminals electrically connected to said plural second electrode portions, wherein said first element arrangement pitch is larger than said second element arrangement pitch and said first electrode arrangement pitch is smaller than said second electrode arrangement pitch.

15. An ink jet recording head according to claim 14, wherein said wiring substrate is a flexible film substrate.

16. An ink jet recording head according to claim 14, wherein said wiring substrate is provided with plural apertures for respectively assembling said plural recording element substrates.

17. An ink jet recording head according to claim 14, wherein the width of each of said plural second electrode terminals is larger than that of each of said plural first electrode terminals.

18. An ink jet recording head according to claim 14, wherein the external width of said first recording element substrate in a direction along the arrangement of said plural first electrode portions is smaller than the external width of said second recording element substrate in a direction along the arrangement of said plural second electrode portions.

19. An ink jet recording head according to claim 14, wherein said first recording element substrate discharges black ink while said second recording element substrate discharges inks of plural colors other than black.

20. An ink jet recording head according to claim 14, wherein the discharge amount of said first recording elements is larger than that of said second recording elements.

21. An ink jet recording head according to claim 14, wherein said recording elements generate thermal energy as the energy.

22. An ink jet recording head comprising:

plural recording element substrates each including a recording element adapted to generate energy to be used for ink discharge and an electrode portion connected to said recording element;

a wiring substrate including electrode terminals electrically connected to said electrode portions of said plural recording element substrates, respectively, and adapted to transmit an electric pulse for ink discharge to said recording elements, respectively; and an element substrate support member for supporting said plural recording element substrates, wherein, on said element substrate support member, said electrode portions of said plural recording element substrates are not positioned in a mutually same height and said electrode portions of said plural recording element substrates and said electrode terminals of said wiring substrate are metal—metal bonded, respectively.

23. An ink jet recording head according to claim 22, wherein said plural recording element substrates are mutually different in at least either of the size and the shape.

24. An ink jet recording head according to claim 22, wherein said wiring substrate is provided with plural apertures in which said plural recording element substrates are respectively assembled and said apertures are mutually different in at least one of the size and the shape.

25. An ink jet recording head according to claim 22, further comprising a wiring substrate support member for supporting said wiring substrate and adapted to be fixed to said element substrate support member, a first adhesive layer for adhering said plural recording element substrates and said element substrate support member, and a second adhesive layer for adhering said element substrate support member and said wiring substrate support member, wherein the sum of the thickness of said plural recording element substrates and the thickness of said first adhesive layer is smaller than the sum of the thickness of said wiring substrate support member and the thickness of said second adhesive layer.

26. An ink jet recording head according to claim 22, wherein said recording elements generate thermal energy as the energy.

* * * * *